US010527980B2

(12) United States Patent
Kobayashi

(10) Patent No.: US 10,527,980 B2
(45) Date of Patent: Jan. 7, 2020

(54) FIXING DEVICE AND IMAGE FORMING APPARATUS

(71) Applicant: FUJI XEROX CO.,LTD., Tokyo (JP)

(72) Inventor: Jouta Kobayashi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/104,941

(22) Filed: Aug. 19, 2018

(65) Prior Publication Data

US 2019/0179241 A1 Jun. 13, 2019

(30) Foreign Application Priority Data

Dec. 7, 2017 (JP) ..... 2017-235483

(51) Int. Cl.
*G03G 15/20* (2006.01)

(52) U.S. Cl.
CPC ..... *G03G 15/2025* (2013.01); *G03G 15/2053* (2013.01); *G03G 15/2064* (2013.01)

(58) Field of Classification Search
CPC ..... G03G 15/2053; G03G 15/2028; G03G 15/2025; G03G 2215/2035
See application file for complete search history.

(56) References Cited

U.S. PATENT DOCUMENTS

2011/0182638 A1* 7/2011 Ishii ..... G03G 15/2053 399/333
2012/0121304 A1* 5/2012 Tokuda ..... G03G 15/2039 399/329
2014/0119787 A1* 5/2014 Hasegawa ..... G03G 15/2053 399/329
2015/0277318 A1* 10/2015 Hazeyama ..... G03G 15/2028 399/329
2017/0176899 A1* 6/2017 Okamoto ..... G03G 15/2025

FOREIGN PATENT DOCUMENTS

JP 2008224875 9/2008
JP 2017125961 7/2017

* cited by examiner

*Primary Examiner* — Walter L Lindsay, Jr.
*Assistant Examiner* — Jessica L Eley
(74) *Attorney, Agent, or Firm* — JCIPRNET

(57) ABSTRACT

A fixing device includes a rotatable fixing belt; a contact portion that comes into contact with an inner peripheral surface of the fixing belt in a width direction; a holding portion disposed opposite the inner peripheral surface of the fixing belt to guide and hold the fixing belt; a pressing unit that presses the fixing belt against the contact portion; a first protrusion and a second protrusion respectively disposed at portions of the holding portion upstream and downstream of the contact portion in a rotation direction of the fixing belt to come into contact with the inner peripheral surface of the fixing belt in the width direction; and a lubricant applied to the inner peripheral surface of the fixing belt. At least one of the first protrusion and the second protrusion has a recess at at least a center portion of the protrusion in a longitudinal direction of the protrusion.

15 Claims, 20 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2017-235483 filed Dec. 7, 2017.

BACKGROUND

Technical Field

The present invention relates to a fixing device and an image forming apparatus.

Summary

According to an aspect of the invention, a fixing device includes a rotatable fixing belt; a contact portion that comes into contact with an inner peripheral surface of the fixing belt in a width direction; a holding portion disposed opposite the inner peripheral surface of the fixing belt to guide and hold the fixing belt; a pressing unit that presses the fixing belt against the contact portion; a first protrusion and a second protrusion respectively disposed at portions of the holding portion upstream and downstream of the contact portion in a rotation direction of the fixing belt to come into contact with the inner peripheral surface of the fixing belt in the width direction; and a lubricant applied to the inner peripheral surface of the fixing belt. At least one of the first protrusion and the second protrusion has a recess at at least a center portion of the protrusion in a longitudinal direction of the protrusion, corresponding to the width direction of the fixing belt, the recess being recessed in a direction away from the inner peripheral surface of the fixing belt and having a width decreasing downstream in the rotation direction of the fixing belt.

BRIEF DESCRIPTION OF THE DRAWINGS

Exemplary embodiments of the present invention will be described in detail based on the following figures, wherein.

DETAILED DESCRIPTION

Exemplary embodiments of the present invention are described below with reference to the attached drawings.

First Exemplary Embodiment

Figure 1:
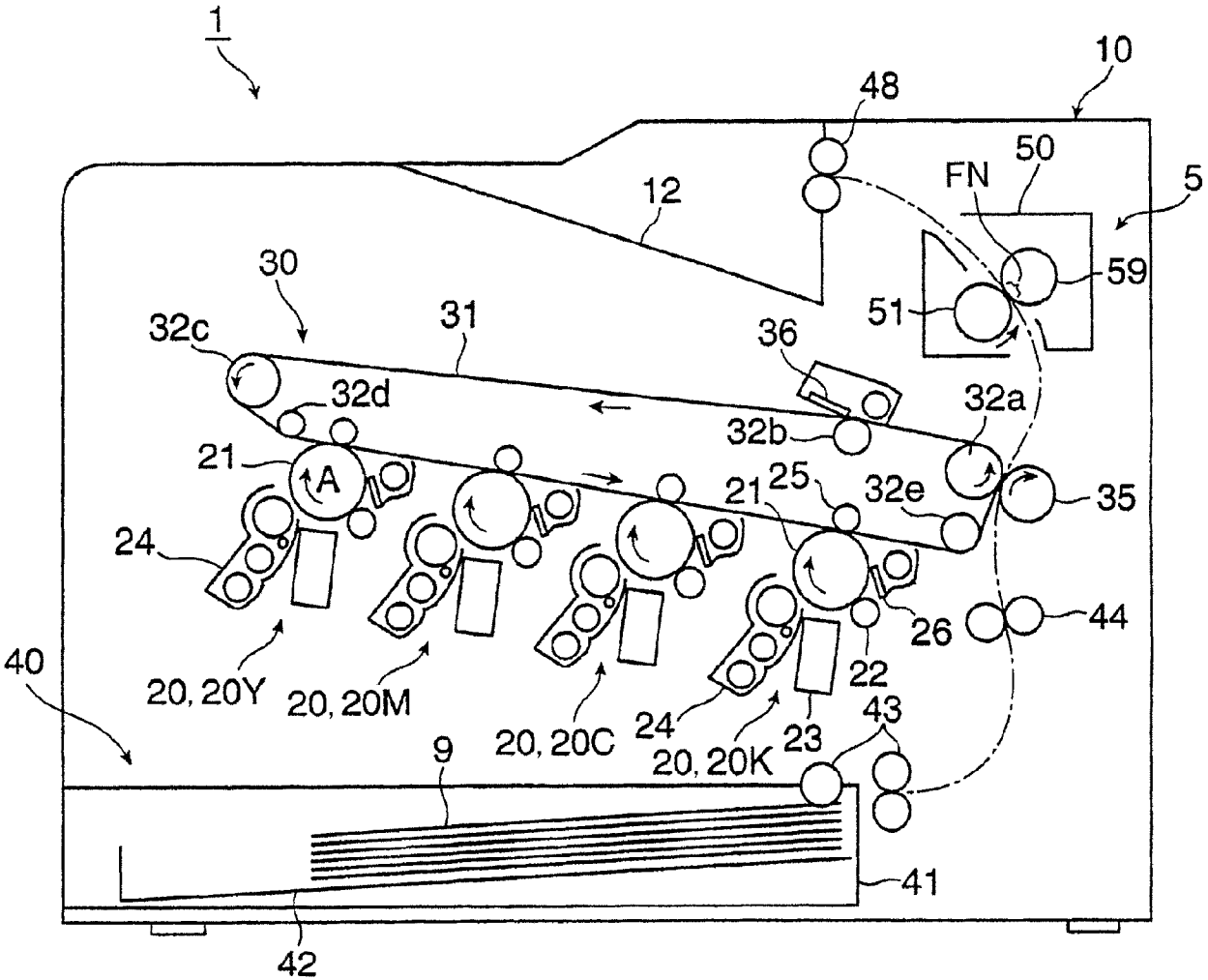
FIG. 1 is a schematic diagram of the entire structure of an image forming apparatus according to a first exemplary embodiment.
Figure 2:
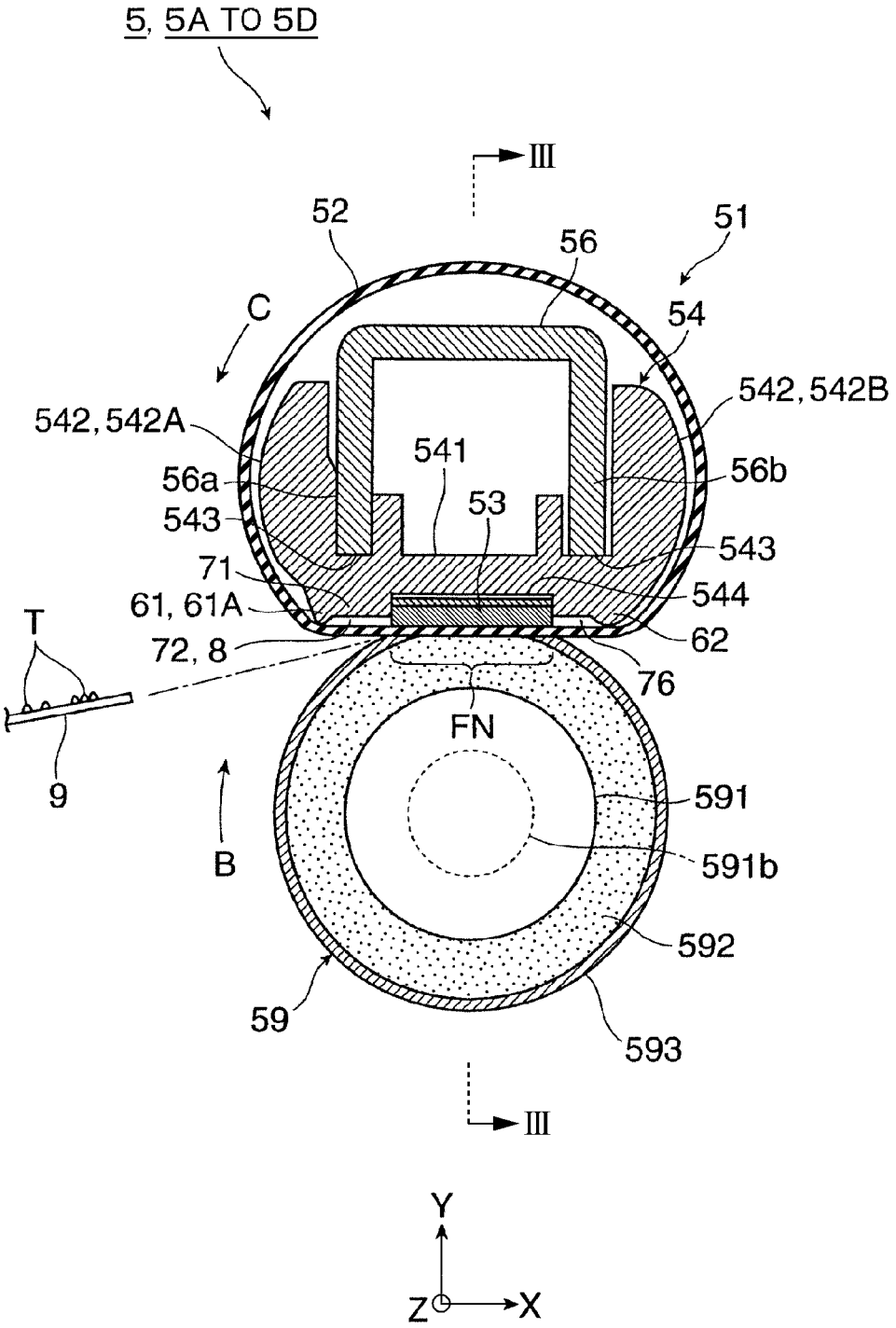
FIG. 2 is a partial sectional view of a related portion of the fixing device according to the first exemplary embodiment.

FIG. 1 and FIG. 2 illustrate an image forming apparatus including a fixing device according to a first exemplary embodiment. FIG. 1 schematically illustrates the entire structure of the image forming apparatus, and FIG. 2 schematically illustrates the structure of a related portion of the fixing device. Arrows denoted with X, Y, and Z in FIG. 2 and subsequent drawings serve as rectangular coordinate axes (and the directions of the axes) respectively indicating the directions of the width, height, and depth of a three-dimensional space assumed in each drawing. A circle of the rectangular coordinate axes illustrated in FIG. 2 denotes that arrow Z indicating the depth direction is directed perpendicularly downward of the plane of FIG. 2.

Entire Structure of Image Forming Apparatus

An image forming apparatus 1 forms an image with a developer on a recording sheet 9, which is an example of a recording medium. The image forming apparatus 1 is, for example, a printer that forms images corresponding to image information acquired from an external device such as an information terminal.

The image forming apparatus 1 includes a housing 10, the entire of which has a box-shaped appearance. As illustrated in FIG. 1, the image forming apparatus 1 includes, in the internal space of the housing 10, components such as image forming units 20, an intermediate transfer device 30, a sheet feeder 40, and a fixing device 5.

A discharged sheet receiving portion 12 is disposed on the upper surface of the housing 10 to allow discharged recording sheets 9 subjected to image formation to be stacked one on another thereon. The dot-dash line in FIG. 1 indicates a rough transport route of the recording sheets 9.

The image forming units 20 are units for forming toner images with toner serving as a developer.

The image forming units 20 according to the first exemplary embodiment are four image forming units 20Y, 20M, 20C, and 20K individually forming developer (toner) images of four colors of yellow (Y), magenta (M), cyan (C), and black (K).

These four image forming units 20 (Y, M, C, and K) each include a photoconductor drum 21, which is a drum-shaped photoconductor that rotates in the direction indicated with arrow A. The following devices are disposed around the photoconductor drum 21. Specifically, in each image forming unit 20 (Y, M, C, or K), devices such as a charging device 22, an exposure device 23, a developing device 24, a first transfer device 25, and a drum cleaner 26 are disposed around the photoconductor drum 21. In FIG. 1, all the components around only the image forming unit 20K for black (K) are denoted with the reference signs 21 to 26. The components around the image forming units 20 for other colors (Y, M, and C) may be or may not be denoted with the reference signs.

The charging device 22 is a device that charges the outer peripheral surface of the corresponding photoconductor drum 21, serving as an image formation area, to a predetermined potential, and includes, for example, a charging member such as a roller that comes into contact with the outer surface of the photoconductor drum 21. The exposure device 23 is a device that irradiates the charged outer peripheral surface of the photoconductor drum 21 with light decomposed into various color components on the basis of predetermined image information to form an electrostatic latent image of a corresponding one of the various color components. The exposure device 23 is connected to a device such as an image processor, not illustrated. The developing device 24 is a device that develops the electrostatic latent image with toner composed of a corresponding one of the various color components to render the image visible as a toner image of the corresponding color (Y, M, C, or K).

The first transfer device 25 is a device that first-transfers the toner image on the corresponding photoconductor drum 21 to the intermediate transfer device 30 (or an intermediate transfer belt 31 of the intermediate transfer device 30). The first transfer device 25 includes, for example, a transfer member such as a roller that comes into contact with the outer surface of the photoconductor drum 21 with the intermediate transfer belt 31, described below, interposed therebetween. As described below, the first transfer device 25 constitutes part of the intermediate transfer device 30. The drum cleaner 26 is a device that removes unnecessary objects such as toner remaining on the outer peripheral surface of the corresponding photoconductor drum 21 subjected to first transfer to clean the outer peripheral surface. The drum cleaner 26 includes, for example, a cleaning member such as a blade and a recovering portion.

Each image forming unit 20 (Y, M, C, or K) operates in the following manner when a controller, not illustrated, receives an image formation command from, for example, an external connection terminal or an operation unit on the image forming apparatus.

First, each photoconductor drum 21 starts rotating, the corresponding charging device 22 charges the outer peripheral surface of the photoconductor drum 21 to a predetermined potential, and then the corresponding exposure device 23 irradiates the charged outer peripheral surface of the photoconductor drum 21 with light corresponding to an image signal of the corresponding color component to form an electrostatic latent image of the corresponding color component.

Subsequently, in each image forming unit 20 (Y, M, C, or K), the developing device 24 (Y, M, C, or K) develops the electrostatic latent image of the color component on the outer peripheral surface of the photoconductor drum 21 with toner of one of the four colors (Y, M, C, and K) corresponding to the color component. Thus, a toner image of one of the four colors is formed on the photoconductor drum 21 of the corresponding image forming unit 20 (Y, M, C, or K). For example, a toner image of yellow (Y) is formed on the photoconductor drum 21 of the image forming unit 20Y.

Subsequently, the toner image of the corresponding color formed on the photoconductor drum 21 of the corresponding image forming unit 20 (Y, M, C, or K) is transported to a first transfer portion, at which the corresponding first transfer device 25 faces the intermediate transfer device 30 (intermediate transfer belt 31 of the intermediate transfer device 30), and first-transferred at the first transfer portion. The first transfer is described below. The photoconductor drum 21 subjected to first transfer is cleaned by the corresponding drum cleaner 26 to be ready for the next image formation.

The intermediate transfer device 30 is a device that allows the toner image formed by each image forming unit 20 to be first-transferred thereto, holds and transports the toner image, and finally second-transfers the toner image to the recording sheet 9.

The intermediate transfer device 30 includes an endless intermediate transfer belt 31 that holds the toner image transferred thereto from the photoconductor drums 21 of the image forming units 20 (Y, M, C, and K). The following devices are disposed around the intermediate transfer belt 31.

The intermediate transfer belt 31 is supported by multiple support rollers 32*a* to 32*e* to rotate (rotationally move) to sequentially pass the first transfer portions of the image forming units 20 (Y, M, C, and K). The support roller 32*a* serves as a driving roller and a second-transfer backup roller.

On the other hand, the first transfer devices 25 of the respective image forming units 20 (Y, M, C, and K) are disposed on the inner side of the intermediate transfer belt 31. A second transfer device 35 is disposed on the outer peripheral surface of the portion of the intermediate transfer belt 31 supported by the support roller 32*a*. The second transfer device 35 includes a second transfer member such as a roller that allows the recording sheet 9 to pass thereby to second-transfer the toner image on the intermediate transfer belt 31 to the recording sheet 9. A belt cleaner 36 is disposed at a portion on the outside of the intermediate transfer belt 31. The belt cleaner 36 removes unnecessary objects such as toner remaining on the outer peripheral surface of the intermediate transfer belt 31 subjected to second transfer to clean the outer peripheral surface.

The sheet feeder 40 is a device that houses recording sheets 9 and feeds the recording sheets 9 to a second transfer position at which the intermediate transfer device 30 performs second transfer.

The sheet feeder 40 includes a sheet container 41 and a pickup device 43. The sheet container 41 is removably attached to the housing 10 and houses the recording sheets 9 of an intended size or type while allowing the recording sheets 9 to be stacked on a sheet receiving plate 42. The pickup device 43 feeds the recording sheets 9 one by one from the sheet container 41.

The sheet feeder 40 feeds appropriate recording sheets 9 one by one from the sheet container 41 using the pickup device 43 during image formation. Each recording sheet 9 fed from the sheet feeder 40 moves forward along the transport route indicated with the dot-dash line, and is finally fed to the second transfer position (position between the intermediate transfer belt 31 and the second transfer device 35) of the intermediate transfer device 30 at the second transfer timing by a pair of transport timing adjustment rollers 44 disposed on the transport route.

The intermediate transfer device 30 sequentially first-transfers the toner images of different colors on the photoconductor drums 21 of the image forming units 20 (Y, M, C, and K) to the outer peripheral surface of the intermediate transfer belt 31 rotating in the direction indicated with arrows, while the toner images are superposed through the transfer operations of the respective first transfer devices 25.

Subsequently, the intermediate transfer device 30 holds the first-transferred toner images on the outer peripheral surface of the rotating intermediate transfer belt 31, and transports the toner images to the second transfer position facing the second transfer device 35. Thereafter, the intermediate transfer device 30 second-transfers the toner images to the recording sheet 9 fed to the second transfer position along the transport route from the sheet feeder 40 with the transfer operation of the second transfer device 35. The outer peripheral surface of the intermediate transfer belt 31 after the second transfer is cleaned by the belt cleaner 36 to be ready for the next image formation.

The fixing device 5 is a device that fixes, to the recording sheet 9, an unfixed toner image second-transferred to the recording sheet 9 by the intermediate transfer device 30.

The fixing device 5 includes, inside a box-shaped housing 50, components such as a fixing belt unit 51 and a pressing roller 59. The fixing belt unit 51 has a heating function. The pressing roller 59 forms an image fixing portion (fixing nip) FN that allows the recording sheet 9 to pass therethrough while pressing the recording sheet 9 against the fixing belt unit 51 to fix (perform heating and pressing on) the toner image to the recording sheet 9. The fixing device 5 is described in detail, below.

In the fixing device 5, when the recording sheet 9 to which a toner image T (FIG. 2) has been second-transferred by the intermediate transfer device 30 moves forward along the transport route indicated with the dot-dash line in FIG. 1 and is introduced into the housing 50, the recording sheet 9 is fed to the image fixing portion FN between the fixing belt unit 51 and the pressing roller 59. At this time, in the fixing device 5, when the recording sheet 9 passes through the image fixing portion FN together with the toner image T, the recording sheet 9 is heated with pressure, so that the toner image T melts and is fixed to the recording sheet 9.

The recording sheet 9 subjected to fixing is discharged from the inside of the housing 50 of the fixing device 5, moves forward along the transport route indicated with the dot-dash line in FIG. 1, is discharged out of the housing 10 with a pair of discharging rollers 48 at the terminal portion of the transport route, and is finally received by the discharged sheet receiving portion 12.

With these operations, the basic operation of the image forming apparatus 1 for forming an image on one side of the recording sheet 9 is finished.

The image forming apparatus 1 is capable of forming a color image constituted of a combination of toner of all the four (Y, M, C, and K) colors or other multiple colors by selectively operating all the four image forming units 20 (Y, M, C, or K) or some other (at least two) image forming units. In addition, the image forming apparatus 1 is capable of forming a single color image, formed from toner of a single color such as black, by operating one of the four image forming units 20 (Y, M, C, or K).

Structure of Fixing Device

The fixing device 5 includes, inside the housing 50 illustrated in FIG. 1, components such as the above-described fixing belt unit 51 and the pressing roller 59, which is an example of a pressing unit.

Figure 3:
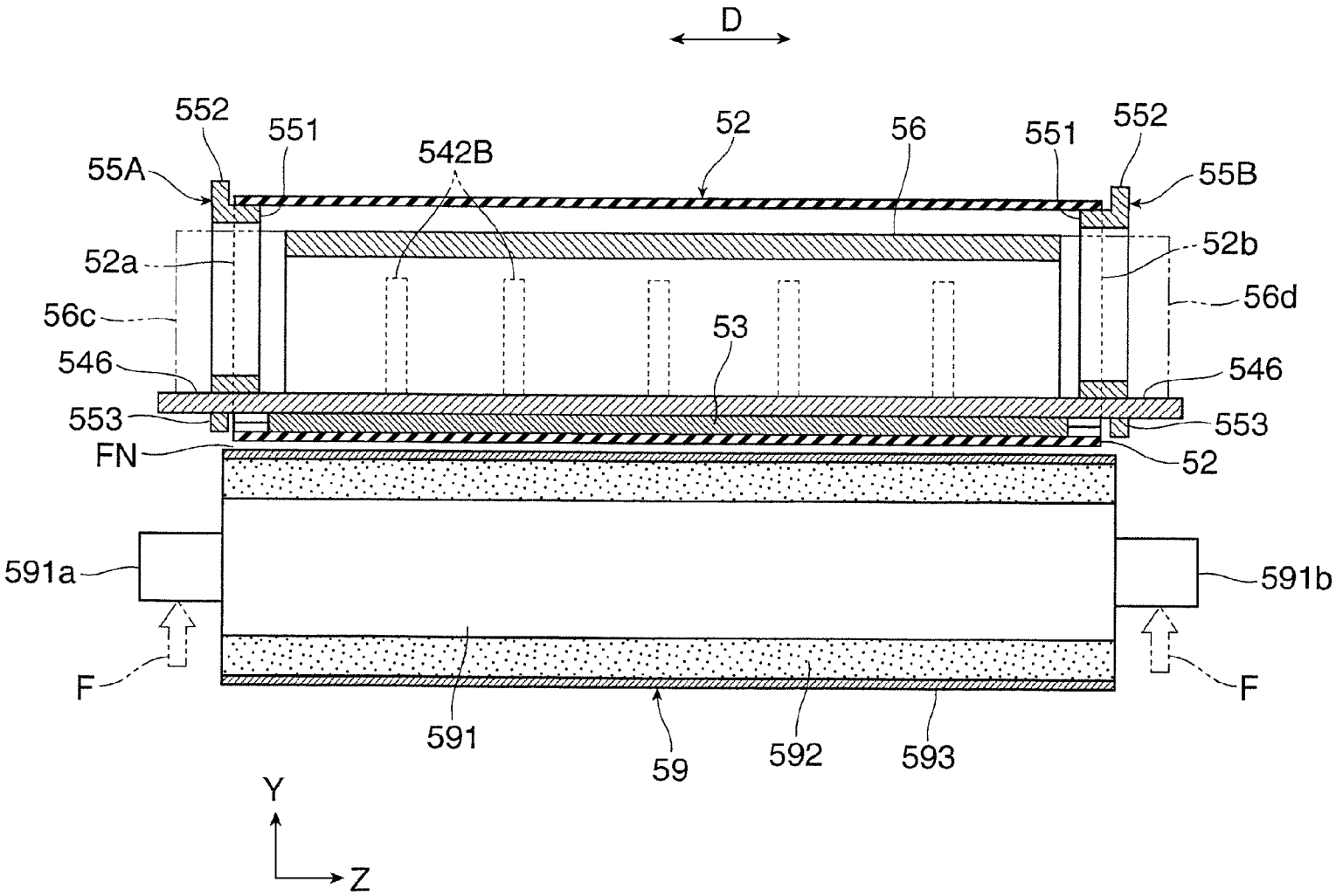
FIG. 3 is a schematic sectional view of the fixing device of FIG. 2 taken along line III-III.

As illustrated in, for example, FIG. 2 and FIG. 3, the fixing belt unit 51 includes a rotatable fixing belt 52, a heating member 53, which is an example of a contact portion that comes into contact with the inner peripheral surface of the fixing belt 52 in the width direction D, a guide holding member 54, which is an example of a holding portion disposed on the inner peripheral surface of the fixing belt 52 to guide and hold the fixing belt 52, and a pair of end supporting members 55A and 55B, which rotatably guide and support the ends of the fixing belt 52 from the inner peripheral surface of the fixing belt 52.

The pressing roller 59 includes a cylindrical roller core 591 made of a material such as metal, an elastic layer 592 disposed on the outer peripheral surface of the roller core 591 and made of a material such as rubber, and a surface layer 593 disposed on the outer peripheral surface of the elastic layer 592 and having releasability.

In the pressing roller 59, shafts 591*a* and 591*b* protruding from both ends of the roller core 591 are disposed at received portions, not illustrated, of the housing 50 to be rotatable with bearings, not illustrated, and movable toward and away from the heating member 53 of the fixing belt unit 51. In the pressing roller 59, the shafts 591*a* and 591*b* of the roller core 591 are pressed with a predetermined pressing force F by a pressing mechanism, not illustrated, against the heating member 53 with bearings and the fixing belt 52 of the fixing belt unit 51 interposed therebetween. When the rotating power is transmitted from a rotating drive device, not illustrated, to the shafts 591*a* and 591*b* of the roller core 591, the pressing roller 59 rotates at a predetermined speed in the direction indicated with arrow B.

In FIG. 3, for convenience of illustration of, for example, the position of the image fixing portion FN, the pressing roller 59 is illustrated slightly apart from the fixing belt 52 of the fixing belt unit 51.

The fixing belt 52 of the fixing belt unit 51 is a belt member formed into a cylinder having a width appropriate for fixing, a predetermined length, and a predetermined thickness.

The fixing belt 52 includes, for example, a belt base made of a material such as polyimide, and a release layer on the outer peripheral surface of the belt base. The fixing belt 52 is driven to rotate in the direction indicated with arrow C upon receipt of rotating power of the pressing roller 59 with which the fixing belt 52 comes into contact at the image fixing portion FN.

The heating member 53 of the fixing belt unit 51 is, for example, a member that includes a plane heater for heating the fixing belt 52.

The plane heater of the heating member 53 is a heating structure having a flat shape and a flat heating area. The plane heater has a predetermined thickness and a flat shape expanding in the rotation direction and the width direction of the fixing belt 52. The plane heater of the heating member 53 has its heating operation controlled by, for example, a power feeder, not illustrated, to have its temperature measured by a temperature sensor, not illustrated, to keep the temperature at a predetermined temperature. The plane heater of the heating member 53 is attached to, for example, a receiving portion, described below, of the guide holding member 54.

The guide holding member 54 of the fixing belt unit 51 includes a body 541 and belt guide portions 542. The body 541 is disposed in the width direction D of the fixing belt 52 at a position at which the image fixing portion FN is formed. The belt guide portions 542 are disposed on the body 541 to come into contact with and guide part of the inner peripheral surface of the fixing belt 52.

The body 541 is a substantially rectangular plate extending in the width direction D of the fixing belt 52.

The belt guide portions 542 include upstream guide portions 542A and downstream guide portions 542B. The upstream guide portions 542A are long-side end portions of the body 541 parallel to the width direction D of the fixing belt 52 and guide a portion of the fixing belt 52 in front of the image fixing portion FN. The downstream guide portions 542B are long-side end portions of the body 541 parallel to the width direction D of the fixing belt 52 and guide the fixing belt 52 after the fixing belt 52 passes through the image fixing portion FN. The upstream guide portions 542A and the downstream guide portions 542B are multiple separate guide portions spaced at predetermined intervals in the width direction D of the fixing belt 52.

At portions (on the first surface) of the body 541 of the guide holding member 54 facing away from the pressing roller 59, long-grooved receiving portions 543 into which portions of a support member 56 are fitted are disposed. The support member 56 supports the guide holding member 54 in the housing 50.

The support member 56 is a member having an angular C-shaped cross section formed by bending, for example, a plate extending in the width direction of the fixing belt 52 so that its long sides extending in the longitudinal direction face the image fixing portion FN. As illustrated in FIG. 3 with the two-dot chain lines, the support member 56 is a member having a length substantially the same length as that of the guide holding member 54 in the longitudinal direction.

The support member 56 has end portions 56*a* and 56*b* of the bent portions fitted into the receiving portions 543 on the first surface. The support member 56 has its both end portions 56*c* and 56*d* in the longitudinal direction fixed and attached to the receiving portions of the housing 50 of the fixing device 5. When the support member 56 is fixed, the fixing belt unit 51 including the guide holding member 54 has its position fixed to the housing 50.

On the other hand, at the portion (second surface) of the body 541 of the guide holding member 54 facing the pressing roller 59 (or the inner peripheral surface of the fixing belt 52), a receiving portion 544 to which the heating member 53 is attachable is disposed.

The receiving portion 544 is a portion extending in the longitudinal direction of the body 541 to face the image fixing portion FN formed by the pressing roller 59 and recessed in a direction away from the pressing roller 59. The plane heater of the heating member 53 is fixed and attached to the receiving portion 544.

Figure 4:
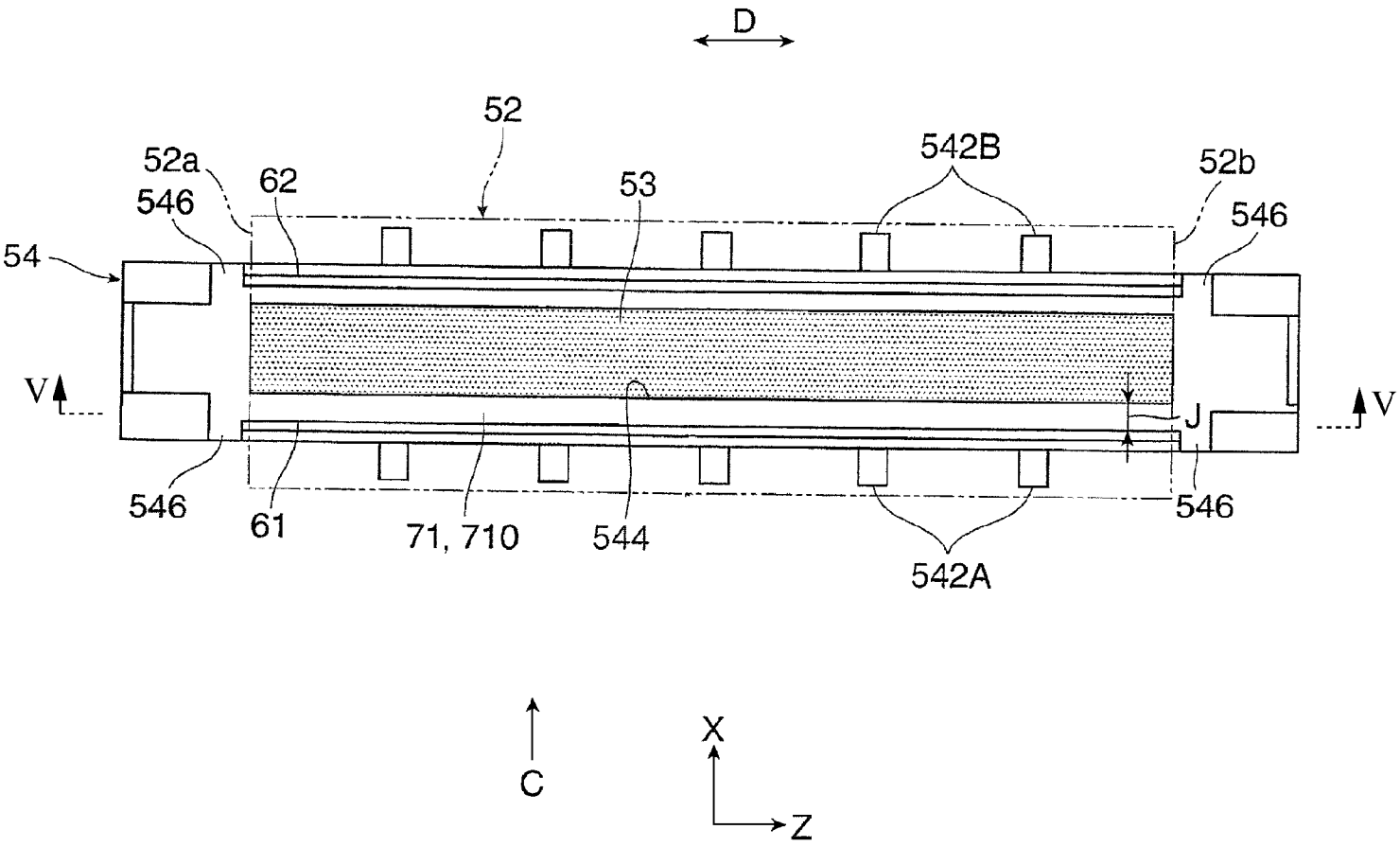
FIG. 4 is a schematic diagram of the structure of a portion (portion excluding a pressing roller viewed from the side on which the pressing roller is to be disposed, throughout the following drawings) of the fixing device illustrated in FIG. 2.

As illustrated in, for example, FIG. 2 or FIG. 4, an upstream protrusion 61, serving as a first protrusion, is disposed on the second surface of the body 541 of the guide holding member 54 at the end portion upstream of the image fixing portion FN (heating member 53 or the receiving portion 544 of the heating member 53) in the rotation direction C of the fixing belt 52. A downstream protrusion 62, serving as a second protrusion, is disposed on the second surface of the body 541 at the end portion downstream of the image fixing portion FN in the rotation direction C of the fixing belt 52.

As illustrated in FIG. 2 and other drawings, both of the upstream protrusion 61 and the downstream protrusion 62 are protrusions protruding from the second surface of the body 541 toward the pressing roller 59. As illustrated in FIG. 4, the upstream protrusion 61 and the downstream protrusion 62 have a shape (protruding strip) that continues in the width direction D of the fixing belt 52 on the second surface of the body 541.

The upstream protrusion 61 and the downstream protrusion 62 are both disposed to come into contact with the inner peripheral surface of the fixing belt 52 in the width direction D. Thus, the fixing belt 52 is shaped to follow the shape of the protrusions 61 and 62 immediately before entering the image fixing portion FN and immediately after passing through the image fixing portion FN. When the fixing belt 52 is kept in this state, the recording sheet 9 introduced into and passing through the image fixing portion FN is less likely to be creased in the width direction D of the fixing belt 52.

As illustrated in, for example, FIG. 2 and FIG. 4, a gap forming portion 71 is disposed on the second surface of the body 541 of the guide holding member 54. The gap forming portion 71 forms a gap 72, in the width direction D of the fixing belt 52, with which the fixing belt 52 does not come into contact in an area between the upstream protrusion 61 and the heating member 53 serving as a contact portion.

The gap forming portion 71 is disposed between the upstream protrusion 61 and the heating member 53. The gap forming portion 71 has an opposing surface 710 that faces the inner peripheral surface of the fixing belt 52 without coming in contact with the surface and extends in the width direction D of the fixing belt 52.

Figure 5:
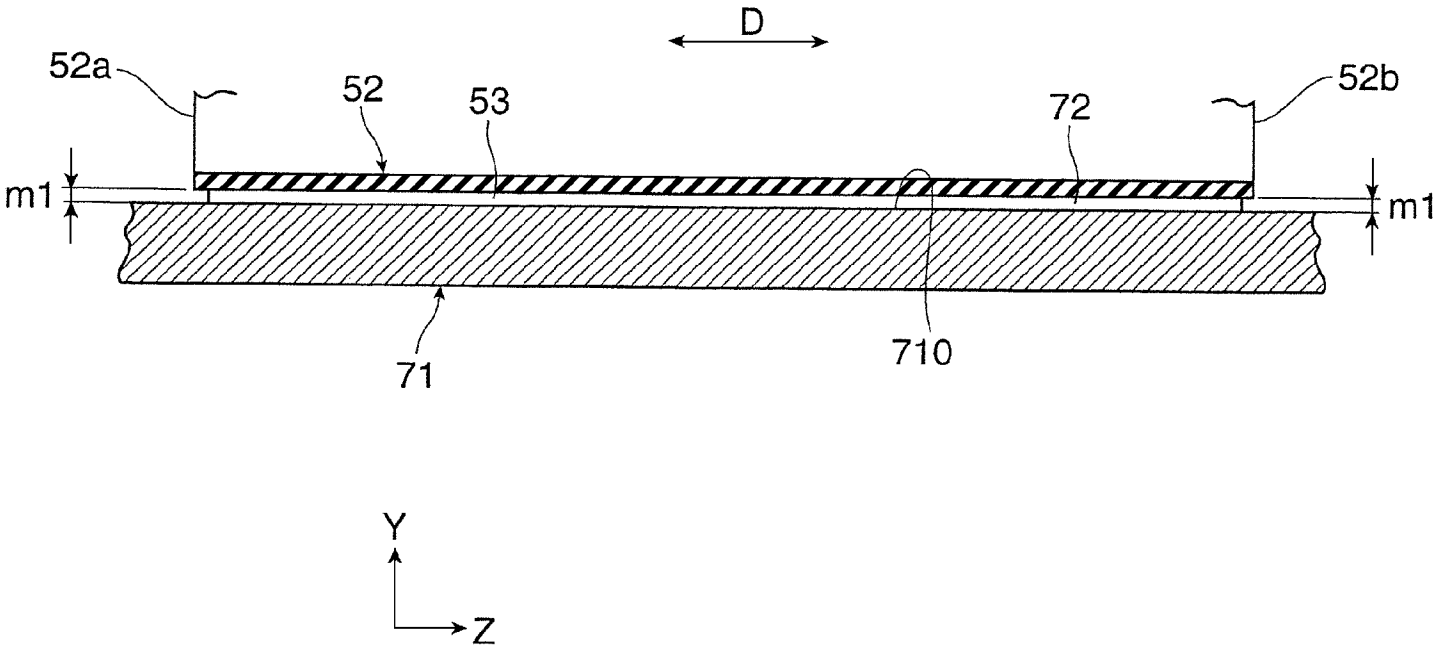
FIG. 5 is a schematic sectional view of a portion of the fixing device illustrated in FIG. 4 and other drawings, taken along line V-V.

As illustrated in FIG. 5, generally, the opposing surface 710 is a flat surface. A distance m by which the opposing surface 710 is spaced apart from the inner peripheral surface of the fixing belt 52 is a predetermined distance ml. The distance ml of the opposing surface 710 is secured by, for example, adjusting the distance by which the opposing surface 710 is spaced apart from the peak of the upstream protrusion 61 and the distance by which the opposing surface 710 is spaced apart from the surface of the heating member 53 that comes into contact with the inner peripheral surface of the fixing belt 52. This opposing surface 710 may be formed by including a step between itself and the heating member 53.

As illustrated in, for example, FIG. 2 or FIG. 4, a gap 76 in the width direction D of the fixing belt 52 with which the fixing belt 52 does not come into contact is disposed on the second surface of the body 541 of the guide holding member 54 between the downstream protrusion 62 and the heating member 53 serving as a contact portion.

As illustrated in FIG. 4, the body 541 of the guide holding member 54 has attachment surface portions 546 at the end portions in the longitudinal direction, for allowing the end supporting members 55A and 55B to be attached thereto. Each attachment surface portion 546 is a flat portion that has none of the receiving portion 544 of the heating member 53, the upstream protrusion 61, the downstream protrusion 62, and the gap forming portion 71.

As illustrated in FIG. 3, the end supporting members 55A and 55B in the fixing belt unit 51 are members each including a support body 551 and a position restricting portion 552. The support body 551 has an arc-shaped support surface that is fitted inside from the corresponding one of both end portions 52*a* and 52*b* of the fixing belt 52 to rotatably guide and support the inner peripheral surface end portion of the fixing belt 52. The position restricting portion 552 protrudes from the support surface to restrict the position of the corresponding one of both end portions 52*a* and 52*b* of the fixing belt 52 at the outside of the support body 551.

As illustrated in FIG. 3, each of the end supporting members 55A and 55B has a cut 553, cut into a portion of the position restricting portion 552 adjacent to the pressing roller 59. The cut 553 is fitted to the attachment surface portion 546 (FIG. 4) of the guide holding member 54 to be fixed to the guide holding member 54.

In the fixing device 5, a lubricant 8 is applied to the inner peripheral surface of the fixing belt 52 to reduce the frictional resistance between the inner peripheral surface of the fixing belt 52 and the components (such as the heating member 53) that come into contact with and pass over the inner peripheral surface of the fixing belt 52.

The lubricant 8 is, for example, applied in advance to the inner peripheral surface of the fixing belt 52. Examples of the lubricant 8 include lubricant oil that is viscous liquid at room temperature and grease that is solid at room temperature.

Operation of Fixing Device

As illustrated in FIG. 2 or FIG. 3, in the fixing device 5, when the pressing roller 59 is brought into pressure contact with the heating member 53 with the fixing belt 52 of the fixing belt unit 51 interposed therebetween at a predetermined pressing force F, the above-described image fixing portion (fixing nip) FN is formed between the pressing roller 59 and the outer peripheral surface of the fixing belt 52.

When the elastic layer 592 of the pressing roller 59 is elastically deformed after the pressing roller 59 is brought into pressure contact with the plane heater of the heating member 53 with the fixing belt 52 interposed therebetween, the image fixing portion FN is formed as a relatively wide pressure contact area having a predetermined width in the rotation direction C of the fixing belt 52, besides the width direction D of the fixing belt 52. Thus, the fixing device 5 has highly efficient fixing ability.

At the timing where a fixing operation is to be performed, in the fixing device 5, the pressing roller 59 rotates at a predetermined speed in the direction indicated with arrow B, so that the fixing belt 52 of the fixing belt unit 51 is driven to rotate in the direction indicated with arrow C. At this time, in the fixing device 5, the heating member 53 in the fixing belt unit 51 starts heating the fixing belt 52 to a temperature appropriate for fixing while the fixing belt 52 is passing by the heating member 53.

Subsequently, when the fixing device 5 becomes ready for performing the fixing operation, as illustrated in FIG. 2, the recording sheet 9 to which the toner image T has been second-transferred is fed to the image fixing portion FN between the fixing belt unit 51 and the pressing roller 59. At this time, as described above, the fixing device 5 heats the recording sheet 9 and the toner image T with pressure while the recording sheet 9 is passing through the image fixing portion FN to melt the toner image T and fix the toner image T to the recording sheet 9.

In the fixing device 5, the fixing belt 52 rotates so as to pass through the image fixing portion FN while being pressed by the pressing roller 59 against the heating member 53 with the pressing force F. At this time, frictional resistance occurs between the heating member 53 and the inner peripheral surface of the fixing belt 52.

However, the fixing device 5 reduces the frictional resistance with the lubricant 8 applied to the inner peripheral surface of the fixing belt 52.

Thus, in the fixing device 5, the fixing belt 52 rotates while relatively smoothly passing through the image fixing portion FN, so that the fixing device 5 is capable of performing an efficient fixing operation.

Detailed Structure of Fixing Device

The fixing device 5 has the following structure in order to prevent the lubricant 8 from leaking out of the end portions 52*a* and 52*b* of the fixing belt 52 in the width direction D.

Figure 6:
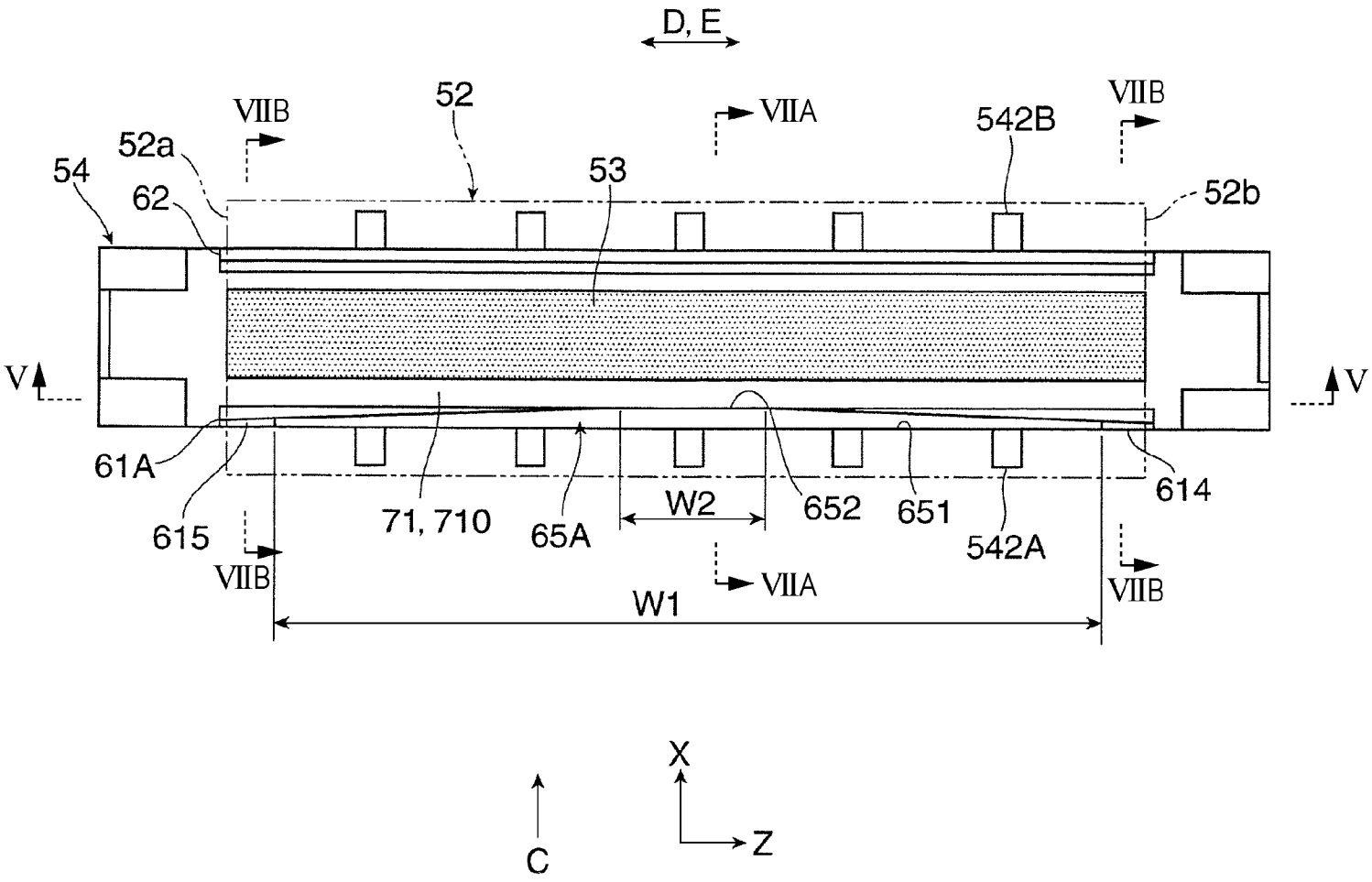
FIG. 6 is a schematic diagram of the detailed structure of a portion of the fixing device illustrated in FIG. 2.
Figure 7A:
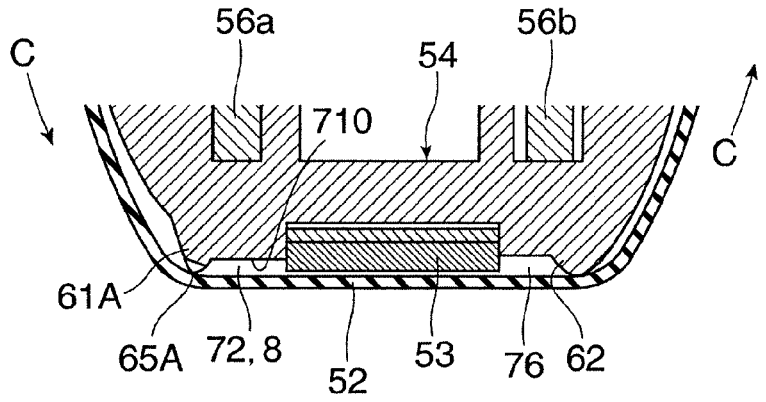
FIG. 7A is a schematic sectional view of a portion of the fixing device illustrated in FIG. 6 taken along line VIIA-VIIA.
Figure 7B:
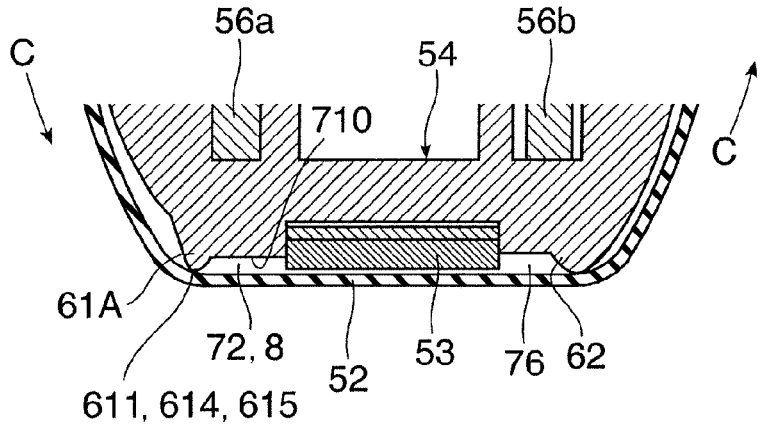
FIG. 7B is a schematic sectional view of a portion of the fixing device illustrated in FIG. 6 taken along line VIIB-VIIB.

Specifically, as illustrated in FIG. 6, FIG. 7A, and FIG. 7B, a fixing device 5A according to a first exemplary embodiment includes a recess 65A at at least a center portion of the upstream protrusion 61 in the longitudinal direction E, corresponding to the width direction D of the fixing belt 52. The recess 65A is recessed in a direction away from the inner peripheral surface of the fixing belt 52 and has its width W decreasing downstream in the rotation direction C of the fixing belt 52.

The upstream protrusion 61 including the recess 65A is referred to as an upstream protrusion 61A according to the first exemplary embodiment, below.

The center portion of the upstream protrusion 61A in the longitudinal direction E is referred to as an inner portion excluding (both) end portions, where the end portions are portions of the upstream protrusion 61 corresponding to the end portions 52*a* and 52*b* of the fixing belt 52 or are both end portions extending from the end portions 52*a* and 52*b* to the end portions of an area (sheet passage area) over which a recording sheet 9 having the maximum width passes.

The width W of the recess 65A is the dimension of the recess 65A in the longitudinal direction E of the upstream protrusion 61A. The reference sign W1 illustrated in FIG. 6 and other drawings denotes the maximum width of the width W of the recess 65A, and the reference sign W2 denotes the minimum width of the width W.

Figure 8:
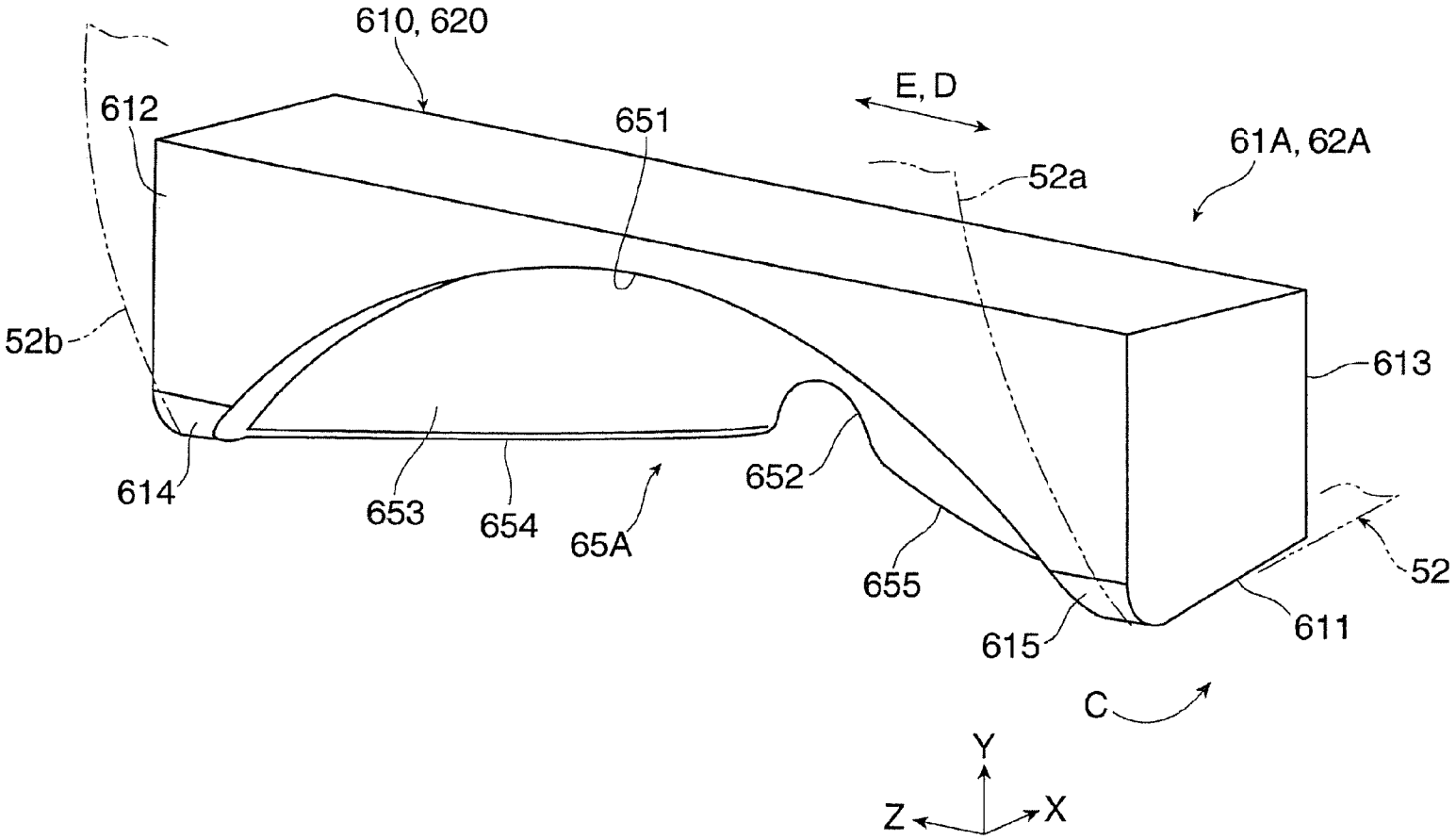
FIG. 8 is a schematic perspective view of an upstream protrusion of the fixing device illustrated in FIG. 6 including a recess, illustrated in an exaggerated manner.
Figure 9A:
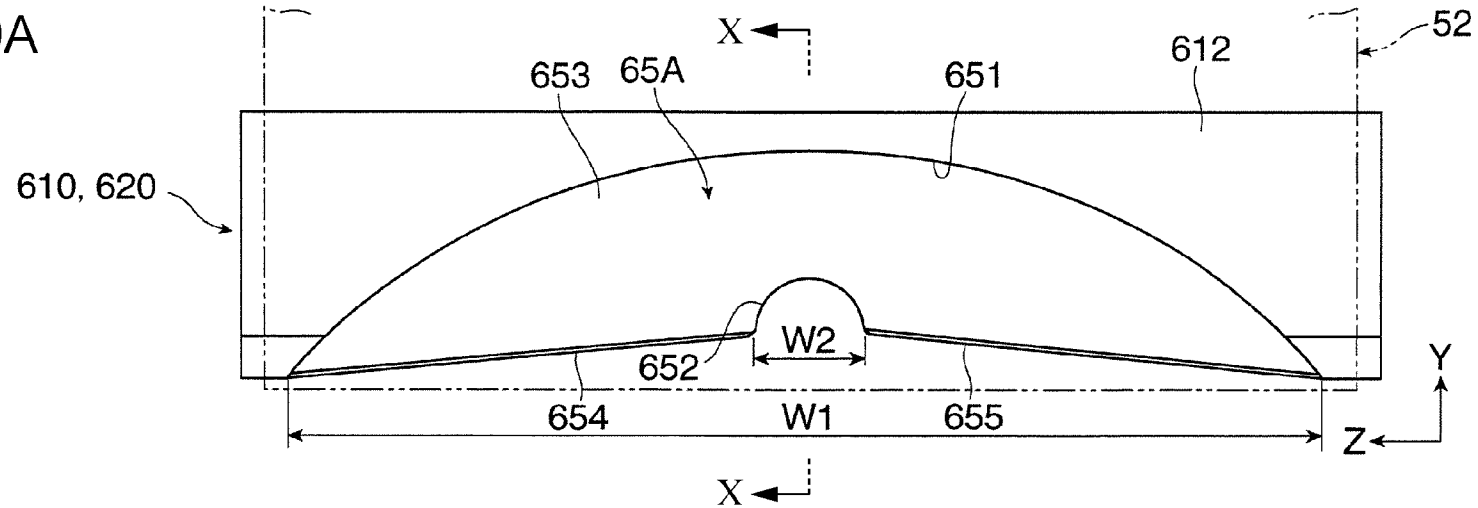
FIG. 9A is a front view of the upstream protrusion in FIG. 8.
Figure 9B:
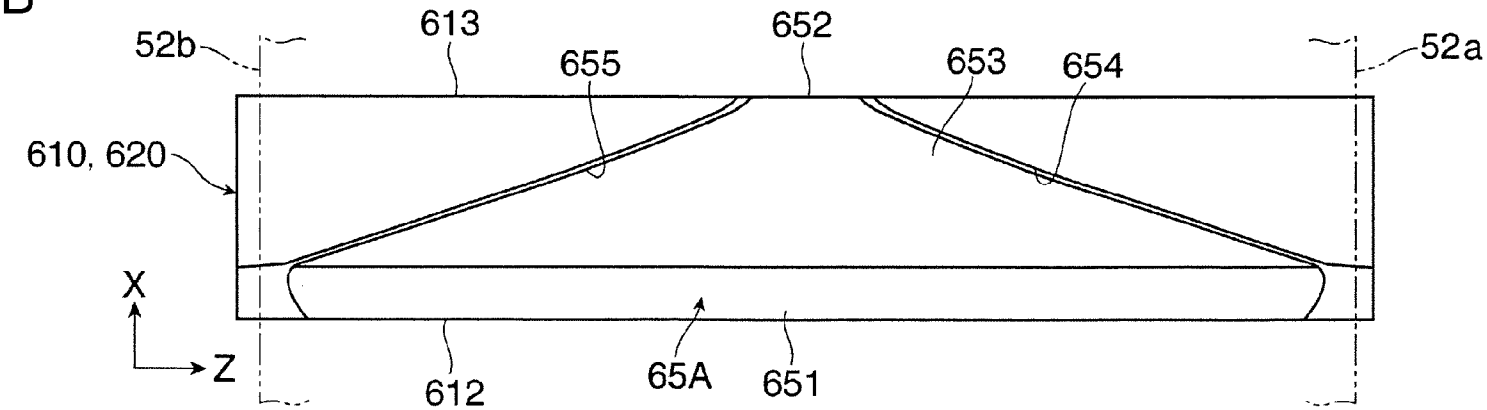
FIG. 9B is a back view of the upstream protrusion in FIG. 8.
Figure 10:
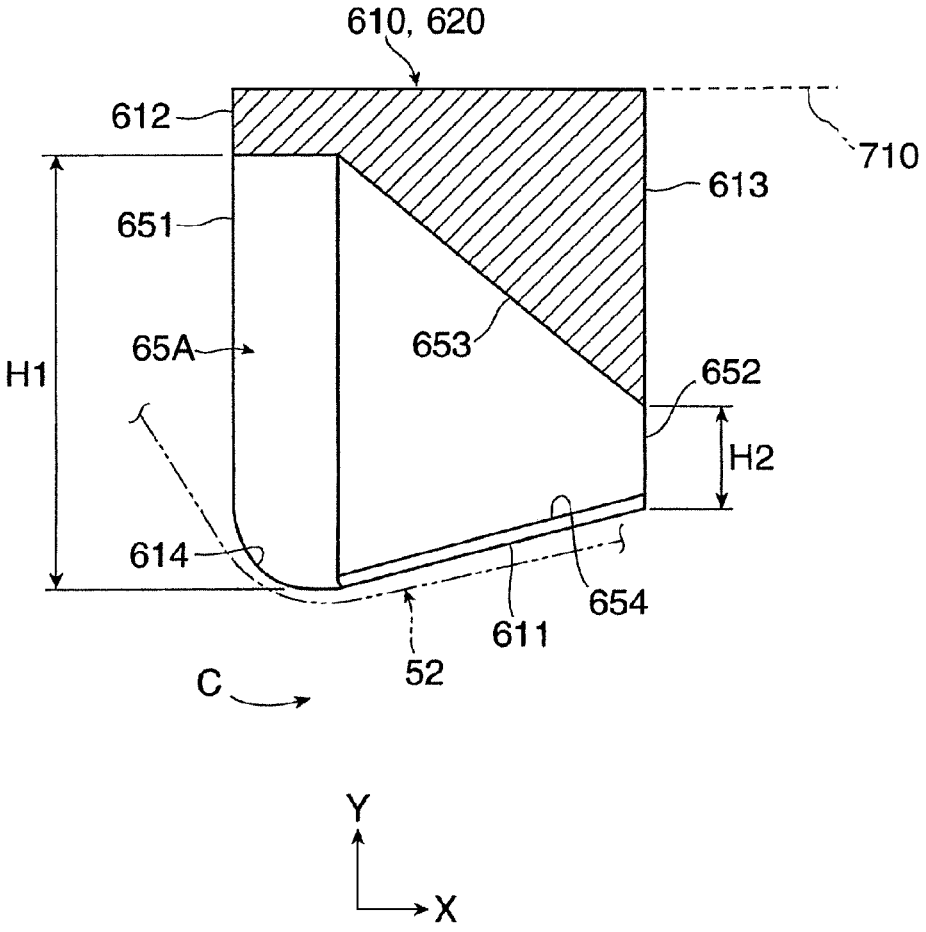
FIG. 10 is a schematic sectional view of the upstream protrusion illustrated in FIG. 9A taken along line X-X.

As illustrated in FIG. 8 to FIG. 10 in exaggerated and enlarged manners, the upstream protrusion 61A including the recess 65A has, before the recess 65A is formed, for example, a form of a protrusion body 610 that is a long, substantially prism shape extending in the width direction D of the fixing belt 52 as a whole. The upstream protrusion 61A having a prism shape has a first surface (opposing surface) 611, which opposes and at least partially comes into contact with the inner peripheral surface of the fixing belt 52. The first surface 611 is an oblique surface that is inclined in a direction away from the inner peripheral surface of the fixing belt 52 downstream in the rotation direction C of the fixing belt 52.

As illustrated in FIG. 8 to FIG. 10 and other drawings, the recess 65A formed in the upstream protrusion 61A formed from the protrusion body 610 has a recessed shape including an arc-shaped recess upstream end 651, an arc-shaped recess downstream end 652, and a curved recess bottom portion 653. The recess upstream end 651 is formed at a front surface portion 612 of the protrusion body 610 upstream in the rotation direction C of the fixing belt 52. The recess downstream end 652 is formed at a rear surface portion 613 of the protrusion body 610 downstream in the rotation direction C of the fixing belt 52. The recess bottom portion 653 connects the recess upstream end 651 to the recess downstream end 652.

The recess upstream end 651 of the recess 65A has a recessed shape having a maximum width W1, and the recess downstream end 652 of the recess 65A has a recessed shape having a minimum width W2.

The recess upstream end 651 is the upstream end of the recess extending substantially throughout in the longitudinal direction E of the front surface portion 612 of the protrusion body 610, excluding part of both end portions. The recess downstream end 652 is the downstream end of the recess located at substantially the center in the longitudinal direction E of the front surface portion 612 of the protrusion body 610.

Thus, the recess 65A has a recessed shape having its width W in the longitudinal direction E gradually decreasing toward the center in the longitudinal direction E, from the recess upstream end 651 to the recess downstream end 652.

As illustrated in FIG. 10, the recess 65A has its depth H decreasing downstream in the rotation direction C of the fixing belt 52.

In the recess 65A, a depth H1 of the recess upstream end 651 is the maximum depth, and a depth H2 of the recess downstream end 652 is the minimum depth. The recess 65A has its depth H having the above relationship. The recess 65A thus has an oblique surface with which the recess bottom portion 653 gradually approaches the opposing surface 611 of the protrusion body 610 from the recess upstream end 651 toward the recess downstream end 652.

Thus, the recess 65A has its depth gradually decreasing from the recess upstream end 651 toward the recess downstream end 652.

As illustrated in FIG. 8 and FIG. 10, boundary portions 654 and 655 of the recess 65A between the recess bottom portion 653 and the opposing surface 611 of the protrusion body 610 are curves extending in a gently curved manner from the recess upstream end 651 toward the recess downstream end 652. To prevent a sharp corner in the recess 65A from, for example, coming into contact with and damaging the inner peripheral surface of the fixing belt 52, the boundary portions 654 and 655 between the recess bottom portion 653 and the opposing surface 611 of the protrusion body 610 are formed of curved taper surfaces that connect the recess bottom portion 653 to the opposing surface 611.

Also in the protrusion body 610 of the upstream protrusion 61A, to prevent a sharp corner from, for example, coming into contact with and damaging the inner peripheral surface of the fixing belt 52, boundary portions 614 and 615 between the opposing surface 611 and end portions of the front surface portion 612 excluding the recess upstream end 651 are formed of curved taper surfaces that connect the end portions to the opposing surface 611.

In the fixing device 5A, when the fixing belt 52 rotates in the direction indicated with arrow C and passes through the upstream protrusion 61A, as illustrated in FIG. 6 or FIG. 7B, the inner peripheral surface of the fixing belt 52 passes while coming into contact with portions near both end portions (boundary portions 614 and 615 and opposing surface 611) of the upstream protrusion 61A in the longitudinal direction E, and, as illustrated in FIG. 7A, without coming into contact with the recess 65A at the center portion of the upstream protrusion 61A in the longitudinal direction E.

Figure 11:
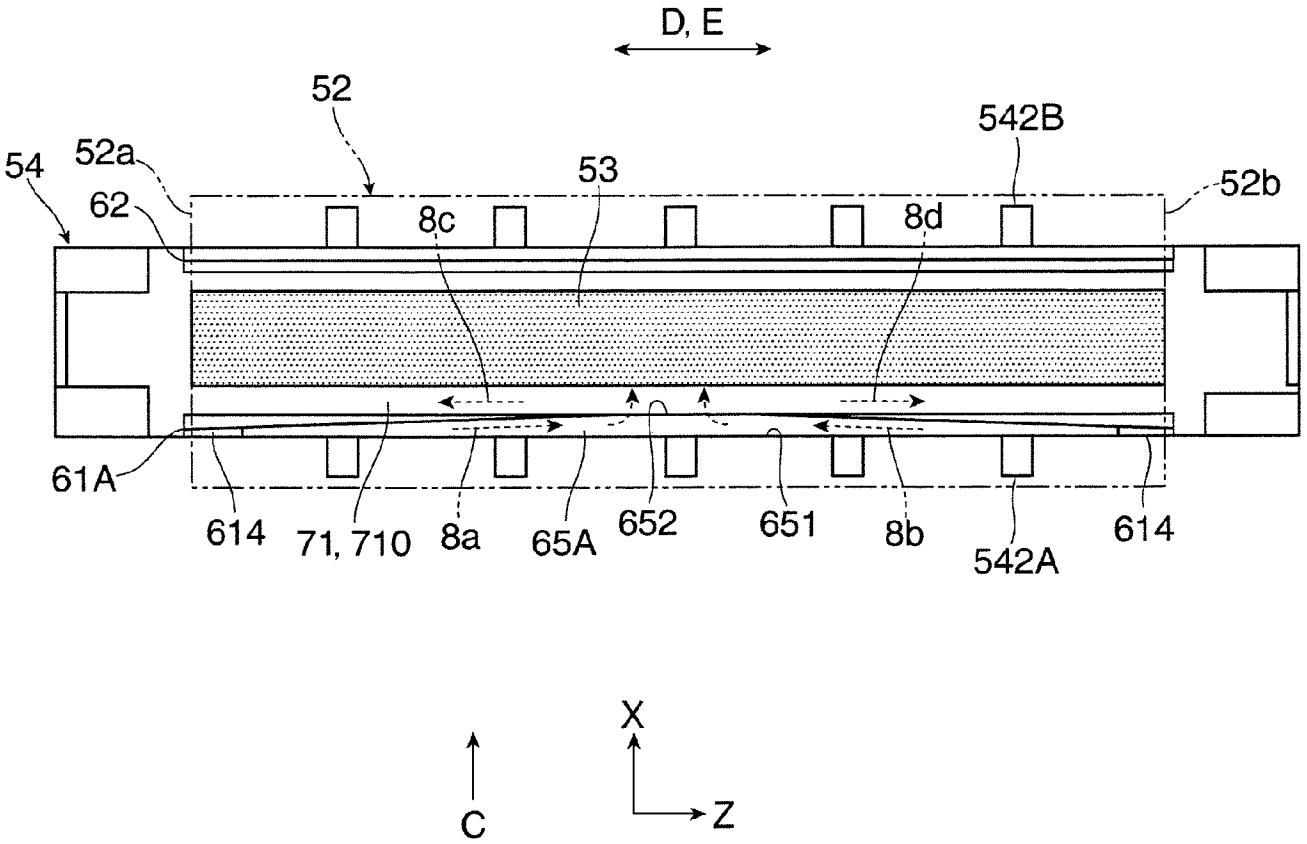
FIG. 11 is a schematic diagram illustrating effects of a portion of the fixing device illustrated in FIG. 6.

As illustrated in FIG. 11, the lubricant 8 applied to and adhering to the inner peripheral surface of the fixing belt 52 is guided to the portion of the recess 65A in the upstream protrusion 61A shaped to have its width W decreasing downstream in the rotation direction C of the fixing belt 52. Thus, as indicated with broken arrows 8*a* and 8*b* in FIG. 11, the lubricant 8 is moved toward the center portion from the end portions of the fixing belt 52 in the width direction D.

The lubricant 8 guided and moved by the recess 65A is gradually guided toward the inner peripheral surface of the fixing belt 52, since the depth H of the recess 65A decreases downstream in the rotation direction C of the fixing belt 52. Thus, the lubricant 8 is efficiently guided by the recess 65A toward the inner peripheral surface of the fixing belt 52.

As illustrated in FIG. 2, in the fixing device 5A, the upstream protrusion 61A including the recess 65A does not touch the pressing roller 59 with the fixing belt 52 interposed therebetween. Thus, the fixing belt 52 is prevented from being pressed by the pressing roller 59 against the recess 65A, so that the space between the fixing belt 52 and the recess 65A is prevented from being squashed. Thus, the recess 65A effectively guides the lubricant 8.

The lubricant 8 moves in the above-described manner regardless of the position of the upstream protrusion 61A with respect to the direction of gravity.

In the fixing device 5A, when the fixing belt 52 passes by the upstream protrusion 61A, the lubricant 8 adhering to the inner peripheral surface of the fixing belt 52 moves toward the center portion area from the end portion areas in the width direction D of the fixing belt 52. Thus, part of the lubricant 8 is prevented from leaking out of the end portions 52*a* and 52*b* of the fixing belt 52.

The fixing device 5A thus prevents defects such as a rise of torque due to the rotation of the pressing roller 59 when part of the lubricant 8 leaks out of the end portions 52*a* and 52*b* of the fixing belt 52 or erroneous rotation of the fixing belt 52.

In the fixing device 5A, the fixing belt 52 passes by the gap 72 in a gap forming portion 71A immediately after passing by the upstream protrusion 61A. At this time, the opposing surface 710 forming the gap 72 forms a long space extending in the width direction D of the fixing belt 52. Thus, as illustrated in FIG. 11, portions 8*c* and 8*d* of the lubricant moved toward the center portion area of the fixing belt 52 by being guided by the recess 65A in the upstream protrusion 61A may be moved to be slightly dispersed to both end areas of the fixing belt 52 in the width direction D.

Thus, in the fixing device 5A, when the fixing belt 52 enters the image fixing portion FN while being pressed by the pressing roller 59 against the heating member 53, a sufficient amount of the lubricant 8 is also fed to both end areas of the inner peripheral surface of the fixing belt 52.

As illustrated in FIG. 2, FIG. 6, FIG. 7A, FIG. 7B, and other drawings, the fixing device 5A has no protrusion that comes into contact with the inner peripheral surface of the fixing belt 52 between the heating member 53 and the upstream protrusion 61A having the recess 65A.

Thus, the lubricant 8 moved toward the center portion of the fixing belt 52 by being guided by the recess 65A in the upstream protrusion 61A is prevented from being unintendedly moved toward the end portions of the fixing belt 52 before the inner peripheral surface of the fixing belt 52 comes into contact with the heating member 53 unlike in the case where the inner peripheral surface passes by another protrusion.

The image forming apparatus 1 including the fixing device 5A prevents the lubricant 8 from leaking out of the end portions 52*a* and 52*b* of the fixing belt 52 in the fixing device 5A, and thus prevents defects such as image quality degradation (fixing error or degradation of image quality due to the lubricant adhering to the recording sheet 9) attributable to the leakage of the lubricant.

Second Exemplary Embodiment

Figure 12:
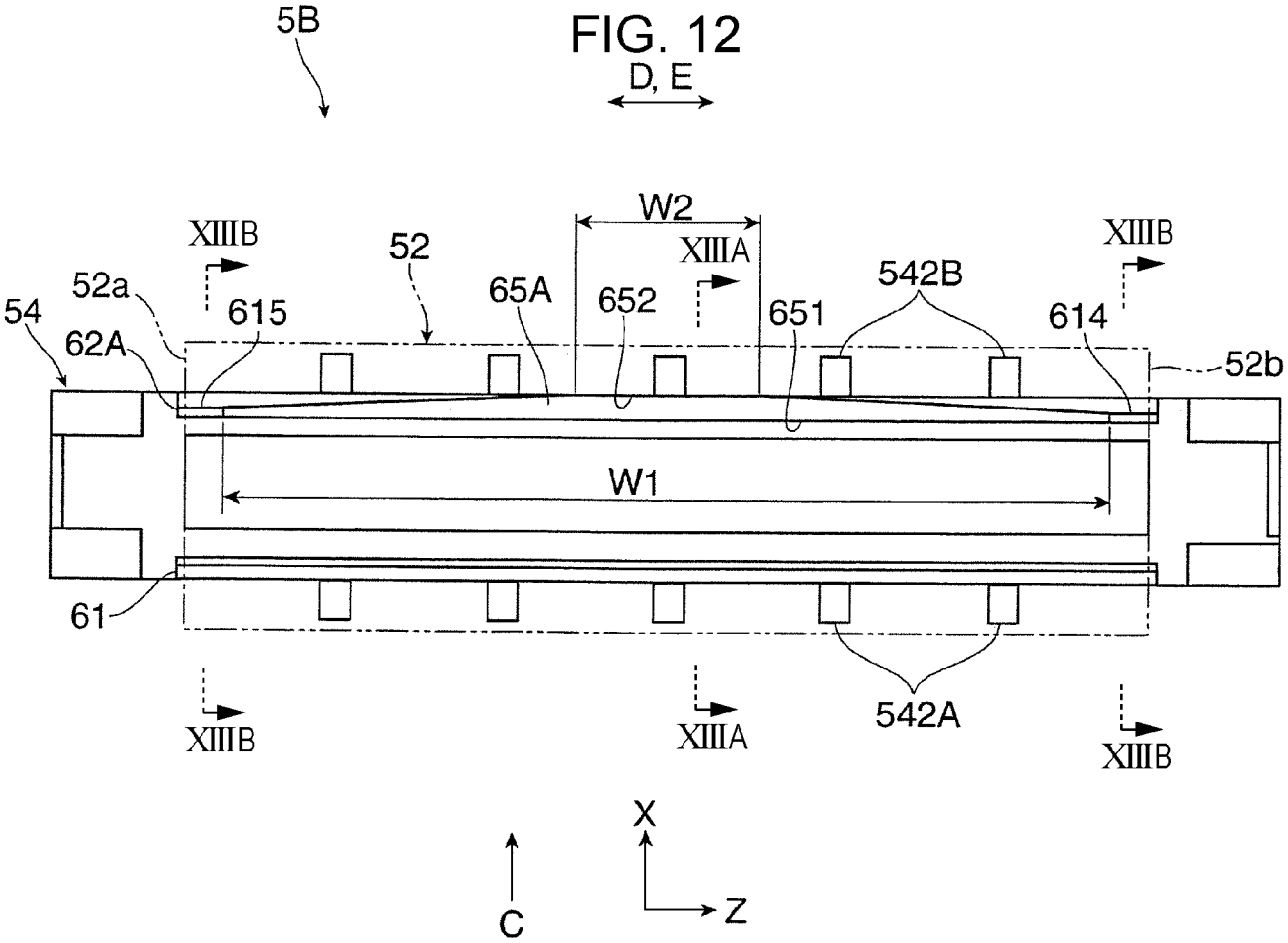
FIG. 12 is a schematic diagram of the detailed structure of a portion of a fixing device according to a second exemplary embodiment.
Figure 13A:
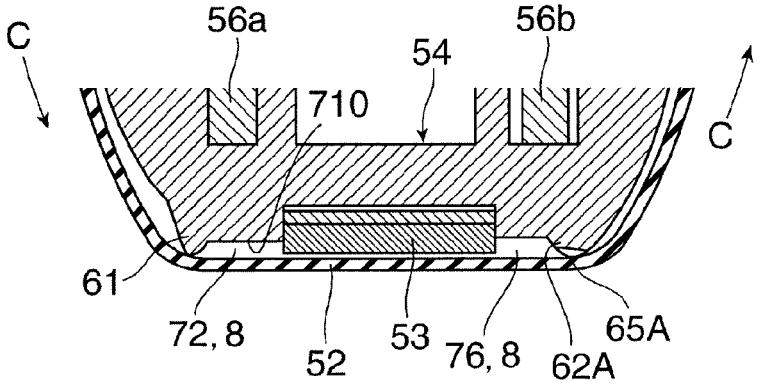
FIG. 13A is a schematic sectional view of a portion of the fixing device illustrated in FIG. 12 taken along line XIIIA-XIIIA.
Figure 13B:
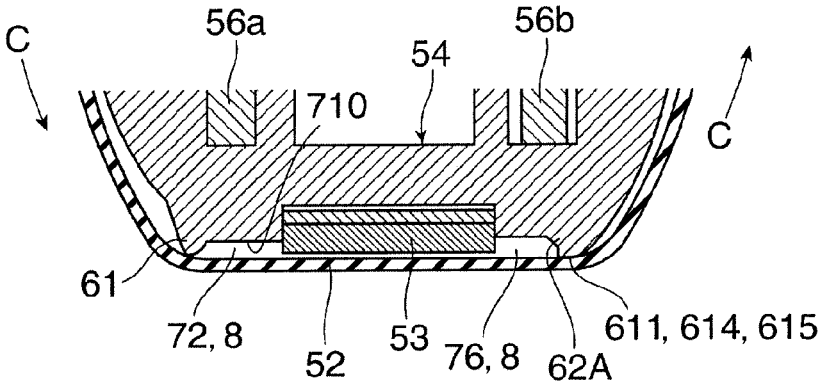
FIG. 13B is a schematic sectional view of a portion of the fixing device illustrated in FIG. 12 taken along line XIIIB-XIIIB.

FIG. 12, FIG. 13A, and FIG. 13B illustrate related portions of a fixing device according to a second exemplary embodiment.

A fixing device 5B according to a second exemplary embodiment has the same structure as the fixing device 5A according to the first exemplary embodiment (FIG. 2 and other drawings) except for the recess 65A formed in the downstream protrusion 62. The components of the fixing device 5B the same as those of the fixing device 5A are denoted with the same reference signs in FIG. 12 and the subsequent drawings, and thus are not generally described below.

As illustrated in FIG. 12 and other drawings, the fixing device 5B has a recess 65A at at least a center portion of the downstream protrusion 62 in the longitudinal direction E, corresponding to the width direction D of the fixing belt 52. The recess 65A has a shape recessed in a direction away from the inner peripheral surface of the fixing belt 52 and has its width W decreasing downstream in the rotation direction C of the fixing belt 52. The downstream protrusion 62 including the recess 65A is referred to as a downstream protrusion 62A according to a second exemplary embodiment, below.

The detailed structure of the recess 65A formed in the downstream protrusion 62A is the same as the structure of the recess 65A (FIG. 8 to FIG. 10 and other drawings) formed in the upstream protrusion 61 according to the first exemplary embodiment. Actually, as illustrated in FIG. 8 and other drawings, similarly to the case of the upstream protrusion 61A, the downstream protrusion 62A in the form of a protrusion body 620 has the recess 65A having the same structure as the recess 65A according to the first exemplary embodiment.

On the other hand, the upstream protrusion 61 according to the second exemplary embodiment is a protrusion protruding continuously in the width direction D of the fixing belt 52, as illustrated in FIG. 2 or FIG. 12.

In the fixing device 5B, as illustrated in FIG. 12 or FIG. 13B, when the fixing belt 52 rotates in the direction indicated with arrow C and passes by the downstream protrusion 62A, the inner peripheral surface of the fixing belt 52 comes into contact with and passes by portions (boundary portions 614 and 615 and opposing surface 611 illustrated in FIG. 8 to FIG. 10) near both end portions of the downstream protrusion 62A in the longitudinal direction E, and without coming into contact with the recess 65A located at the center portion of the downstream protrusion 62A in the longitudinal direction E, as illustrated in FIG. 13A.

Figure 14:
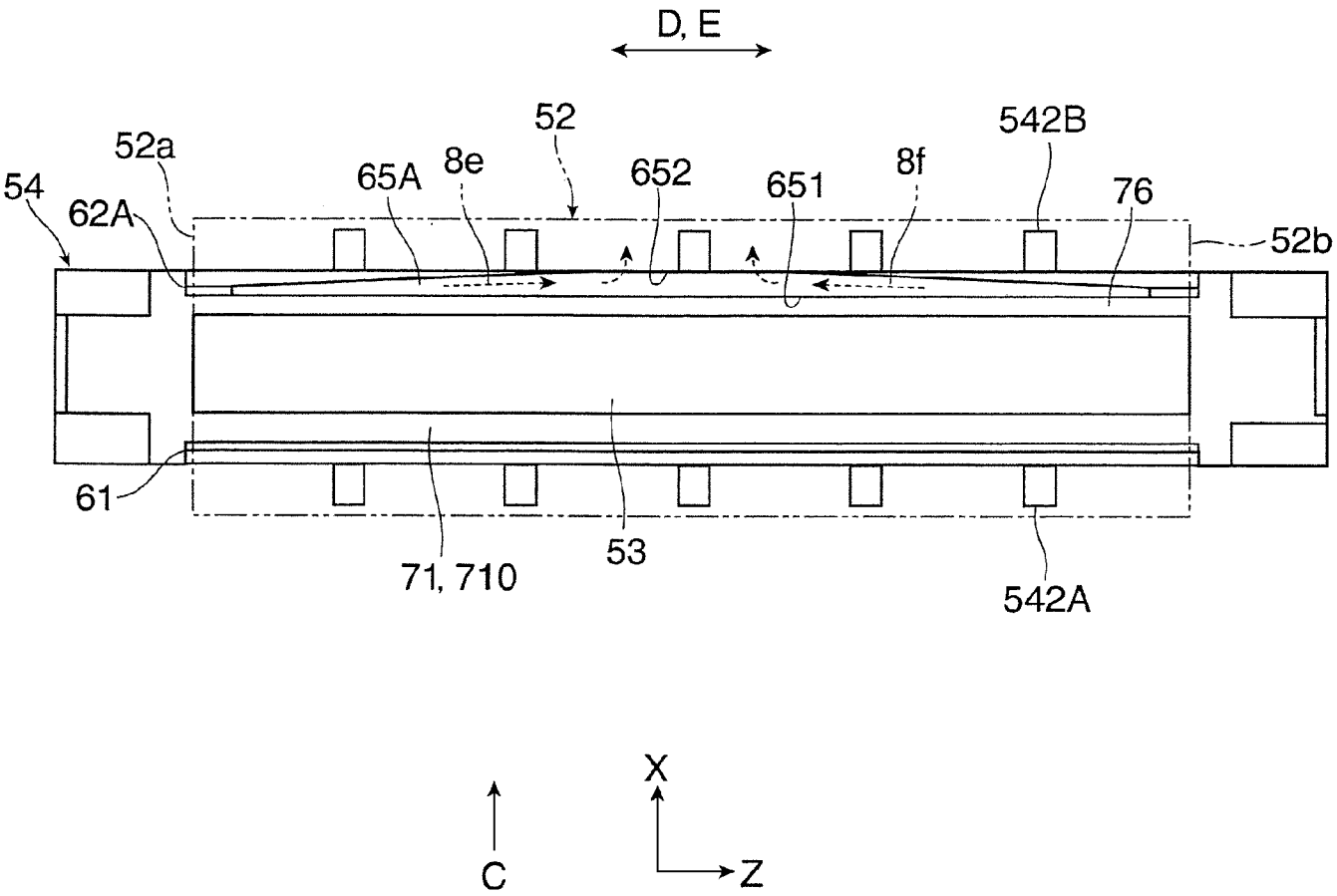
FIG. 14 is a schematic diagram illustrating effects of a portion of the fixing device illustrated in FIG. 12.

Here, as illustrated in FIG. 14, the lubricant 8 applied to and adhering to the inner peripheral surface of the fixing belt 52 is guided to a portion of the recess 65A of the downstream protrusion 62A having a width W decreasing downstream in the rotation direction C of the fixing belt 52. Thus, as indicated with broken arrows 8*e* and 8*f* in FIG. 14, the lubricant 8 is moved toward the center portion from the end portions of the fixing belt 52 in the width direction D.

The lubricant 8 guided and moved by the recess 65A is gradually guided toward the inner peripheral surface of the fixing belt 52, since the depth H of the recess 65A decreases downstream in the rotation direction C of the fixing belt 52. Thus, the lubricant 8 is efficiently guided by the recess 65A toward the inner peripheral surface of the fixing belt 52.

As illustrated in FIG. 2, also in the fixing device 5B, the downstream protrusion 62A including the recess 65A does not touch the pressing roller 59 with the fixing belt 52 interposed therebetween. Thus, the fixing belt 52 is prevented from being pressed by the pressing roller 59 against the recess 65A, so that the space between the fixing belt 52 and the recess 65A is prevented from being squashed. Thus, the recess 65A effectively guides the lubricant 8.

The lubricant 8 moves in the above-described manner regardless of the position of the downstream protrusion 62A with respect to the direction of gravity.

In the fixing device 5B, when the fixing belt 52 passes by the downstream protrusion 62A, the lubricant 8 adhering to the inner peripheral surface of the fixing belt 52 moves toward the center portion area from the end portion areas in the width direction D of the fixing belt 52. Thus, part of the lubricant 8 is prevented from leaking out of the end portions 52*a* and 52*b* of the fixing belt 52.

As in the case of the image forming apparatus 1 according to the first exemplary embodiment including the fixing device 5A, the image forming apparatus 1 including the fixing device 5B thus prevents defects such as image quality degradation attributable to leakage of the lubricant from end portions of the fixing belt 52 in the fixing device 5B.

Other Exemplary Embodiments

Figure 15:
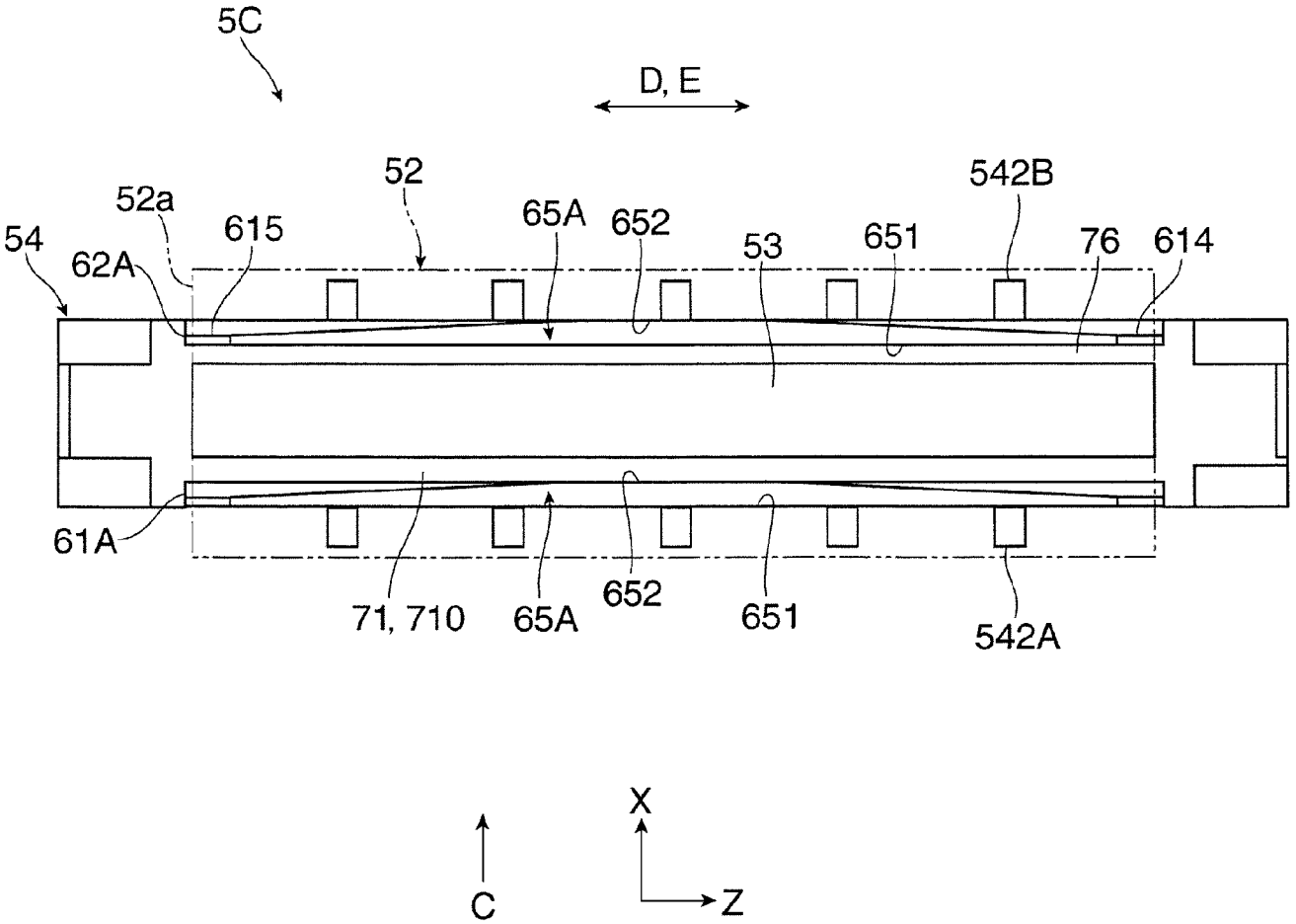
FIG. 15 is a schematic diagram of the detailed structure of a portion of a fixing device in which each of the upstream protrusion and the downstream protrusion has a recess.

As illustrated in detail in FIG. 15, examples of the fixing device 5 include a fixing device 5C in which each of the upstream protrusion 61 and the downstream protrusion 62 has a recess 65A. The fixing device 5C includes an upstream protrusion 61A (FIG. 6 to FIG. 10) including the recess 65A according to the first exemplary embodiment to serve as the upstream protrusion 61, and a downstream protrusion 62A (FIG. 12 and FIG. 13) including the recess 65A according to the second exemplary embodiment to serve as the downstream protrusion 62.

In the fixing device 5C, the recess 65A of the upstream protrusion 61 effectively guides the lubricant 8 toward the center portion, and the recess 65A of the downstream protrusion 62A effectively guides the lubricant 8 toward the center portion. This structure further prevents part of the lubricant 8 from leaking out of the end portions 52*a* and 52*b* of the fixing belt 52.

As illustrated in FIG. 2 and FIG. 15, the fixing device 5C does not include an extra portion that widely comes into contact with, at the center portion in the width direction D, the inner peripheral surface of the fixing belt 52 in the course from the downstream protrusion 62A to the upstream protrusion 61A in the rotation direction C of the fixing belt 52. Thus, the fixing device 5C prevents the lubricant 8 moved toward the center portion of the fixing belt 52 by being guided by the recess 65A in the downstream protrusion 62A from being unintendedly moved toward the end portions of the fixing belt 52 from the center portion unlike in the case where the inner peripheral surface comes into contact with, for example, an extra portion in the course from the downstream protrusion 62A to the upstream protrusion 61A.

Figure 16:
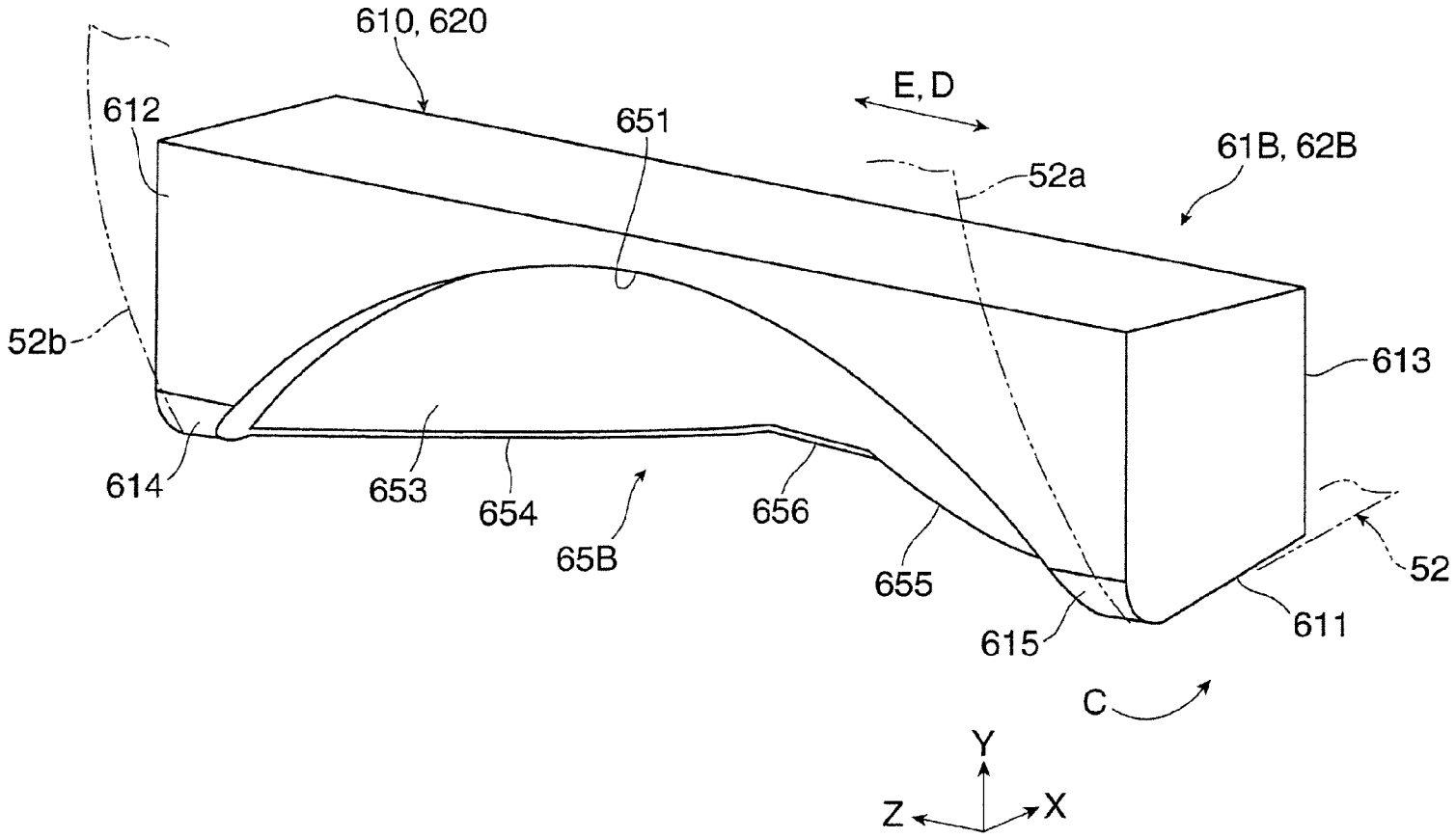
FIG. 16 is a schematic perspective view of another structure of the recess formed in the upstream protrusion or the downstream protrusion in an exaggerated manner.
Figure 17A:
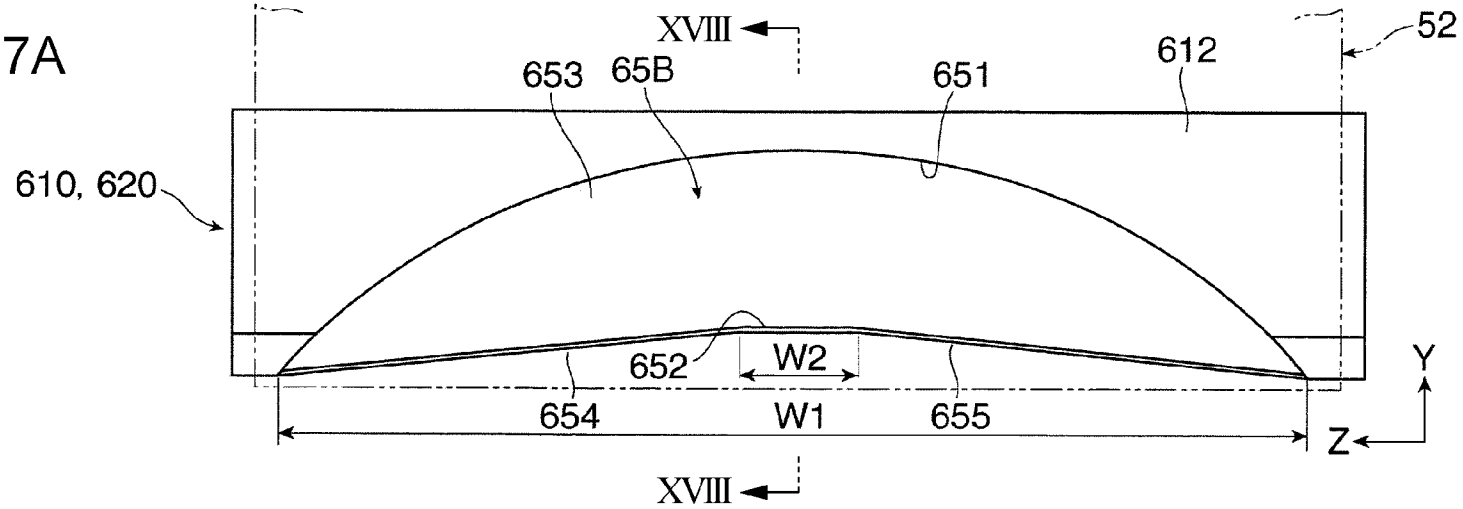
FIG. 17A is a front view of components such as the upstream protrusion illustrated in FIG. 16.
Figure 17B:
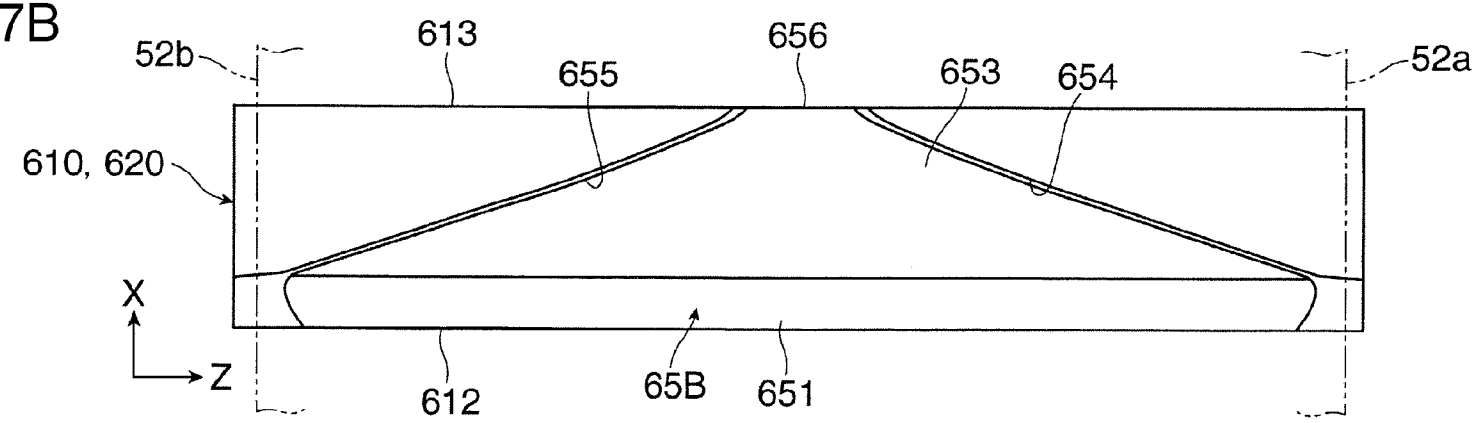
FIG. 17B is a back view of components such as the upstream protrusion illustrated in FIG. 16.
Figure 18:
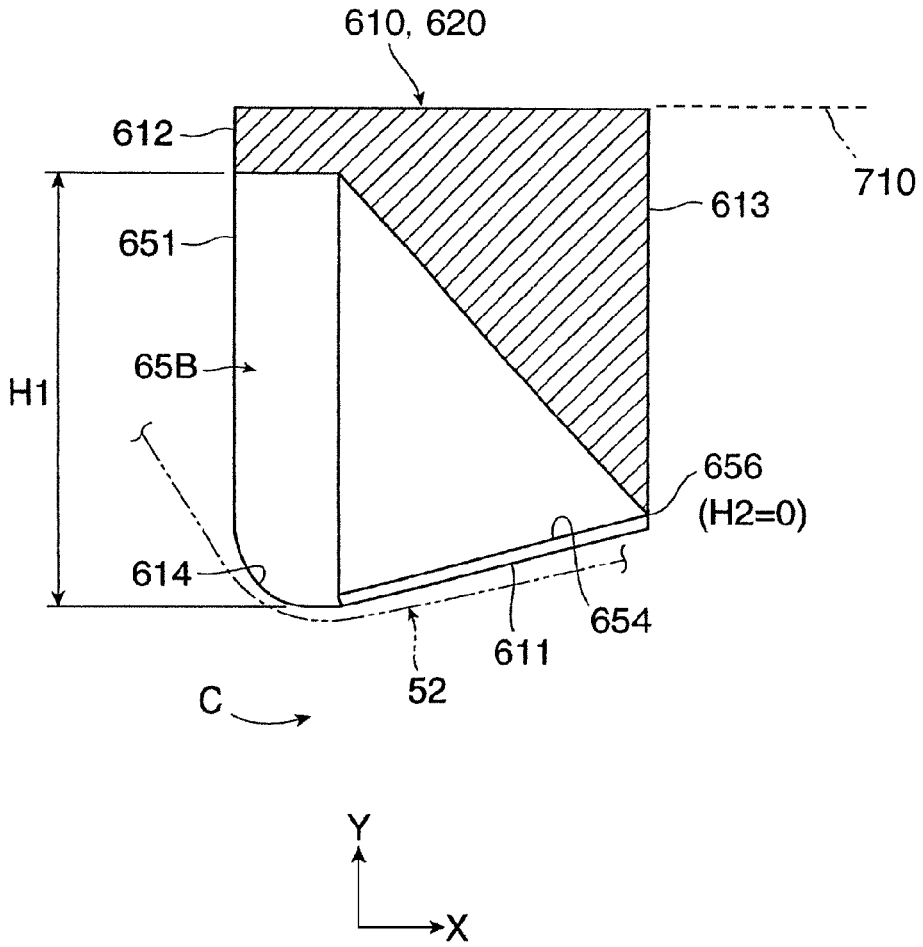
FIG. 18 is a schematic sectional view of components such as the upstream protrusion illustrated in FIG. 17A, taken along line XVIII-XVIII.

Each of the fixing devices 5A, 5B and 5C according to the first and second exemplary embodiments may include, instead of the recess 65A (FIG. 8 to FIG. 10 and other drawings), for example, a recess 65B having a structure illustrated in FIG. 16 to FIG. 18.

A recess upstream end 651 of the recess 65B has a recessed shape having a maximum width W1, and a downstream end 656 of the recess 65B has a minimum width W2. As illustrated in FIG. 18, the recess 65B is different from the recess 65A in that the downstream end 656 is an end portion not recessed and has a depth H2 of zero (H2=0). Other points are the same between the recess 65B and the recess 65A.

The recess 65B may be formed at either one or both of the upstream protrusion 61 and the downstream protrusion 62.

In the fixing device 5 that includes either one or both of the upstream protrusion 61 including the recess 65B and the downstream protrusion 62 including the recess 65B, the lubricant 8 is moved toward the center portion from the end portions of the fixing belt 52 in the width direction D when the fixing belt 52 passes by the recess 65B. Besides, the lubricant 8 is efficiently guided toward the inner peripheral surface of the fixing belt 52 as it approaches, particularly, the downstream end 656 of the recess 65B compared to the case of the recess 65A.

Figure 19:
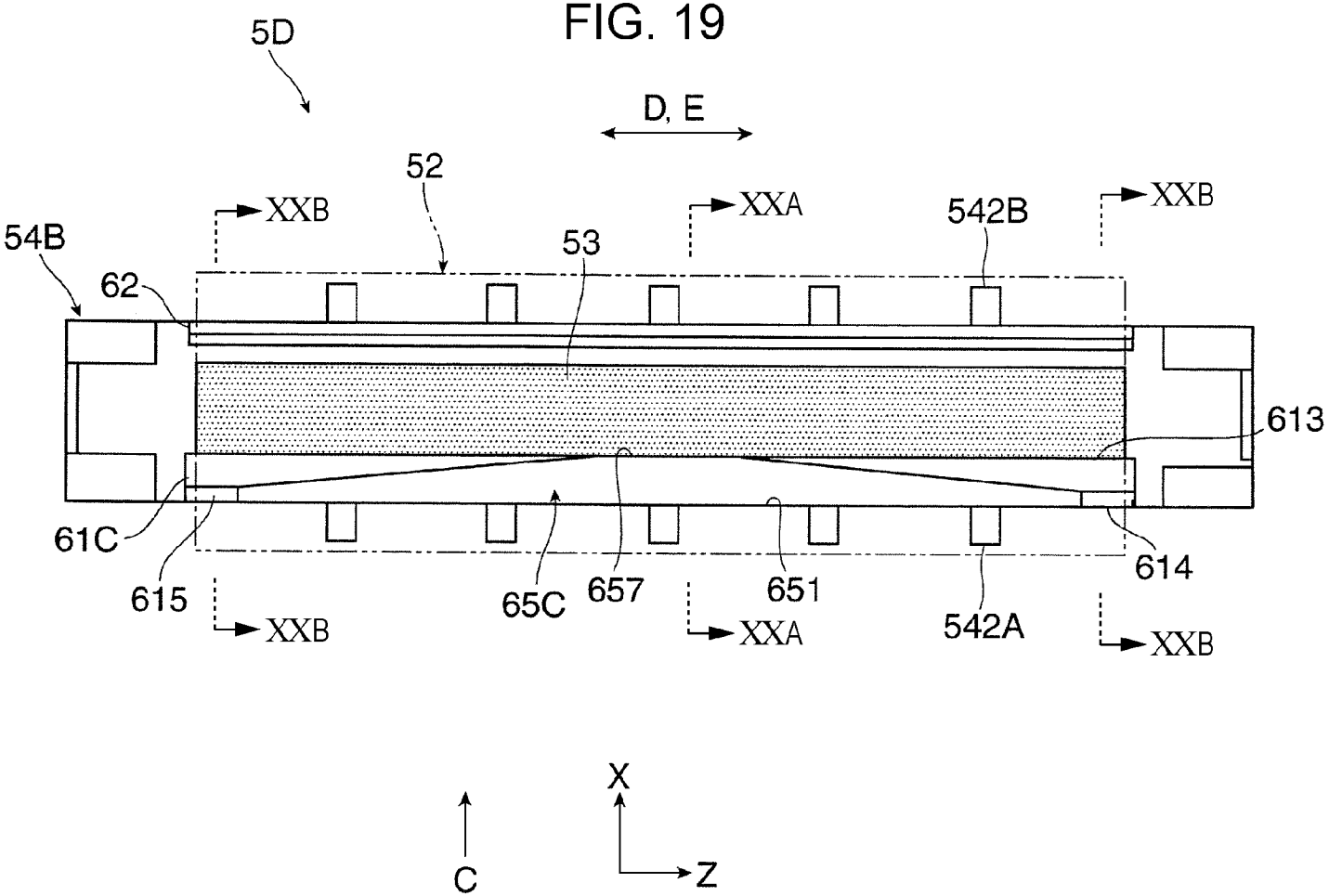
FIG. 19 is a schematic diagram of the detailed structure of a portion of the fixing device including a guide holding member that does not include a gap forming portion.
Figure 20A:
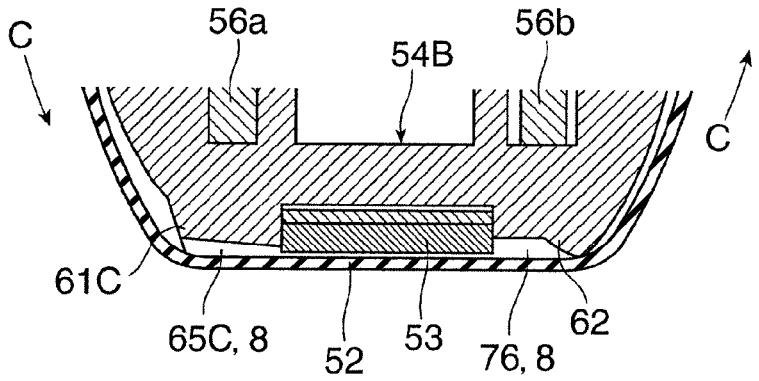
FIG. 20A is a schematic sectional view of a portion of the fixing device illustrated in FIG. 19, taken along line XXA-XXA.
Figure 20B:
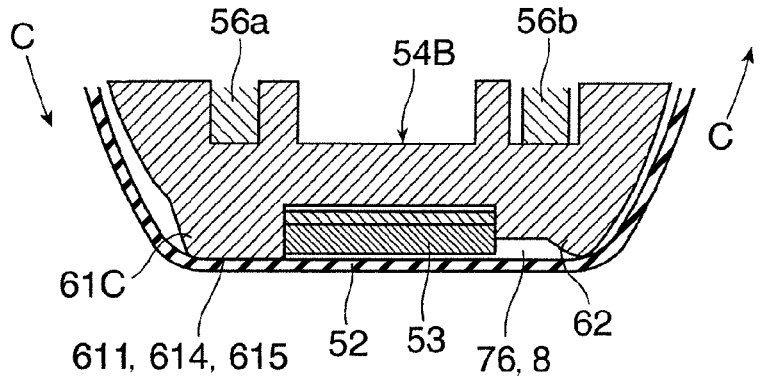
FIG. 20B is a schematic sectional view of a portion of the fixing device illustrated in FIG. 19, taken along line XXB-XXB.

Each of the fixing devices 5A, 5B and 5C according to the first and second exemplary embodiments may include a guide holding member 54B that does not include a gap forming portion 71 as illustrated in FIG. 19, FIG. 20A, and FIG. 20B, instead of the guide holding member 54 including the gap forming portion 71.

As illustrated in FIG. 19, FIG. 20A, or FIG. 20B, an upstream protrusion 61C including a recess 65C extends to the position at which the rear surface portion 613 in the rotation direction C of the fixing belt 52 reaches the heating member 53. When the upstream protrusion 61 has the recess 65C, the recess 65C is different from the recess 65A or the recess 65B in that it has a greater dimension in the rotation direction C of the fixing belt 52. However, other points of the structure remain the same as those of the recess 65A or 65B.

Particularly, a fixing device 5D including the guide holding member 54B including the upstream protrusion 61C having the recess 65C is capable of, for example, more reliably guiding the lubricant 8 to the center portion in the width direction D of the fixing belt 52 with an increase in time for which the fixing belt 52 is in contact with the upstream protrusion 61C.

Each of the fixing devices 5A, 5B and 5C according to the first and second exemplary embodiments has, for example, a structure in which the recess 65A or 65B is formed at the center portion of the upstream protrusion 61 or the downstream protrusion 62 in the longitudinal direction E excluding end portions. However, the recess 65A or 65B may extend from the end portions (positions corresponding to the end portions 52*a* and 52*b* of the fixing belt) of the upstream protrusion 61 or the downstream protrusion 62 in the longitudinal direction E.

In addition, the fixing device 5 (5A or 5B) may have the following structure, for example.

For example, instead of being held at a portion (receiving portion 544) of the guide holding member 54, the heating member 53 of the fixing belt unit 51 may be held by another member, for example, a support member dedicated for the heating member 53 or may be held by being directly attached to a portion of the housing 50.

Instead of the heating member 53, a pressure contact member (such as a pad member) may be used as the contact portion that comes into contact with the inner peripheral surface of the fixing belt 52 of the fixing belt unit 51 at the image fixing portion FN. When this pressure contact member is used, a belt that is heated by induction heating or a belt that is heated by a heater disposed at a portion other than the image fixing portion FN may be used as an example of the fixing belt 52.

The lubricant 8 may be applied to the inner peripheral surface of the fixing belt 52 by, for example, a lubricant feeder that comes into contact with the inner peripheral surface of the fixing belt 52 to feed the lubricant 8 to the inner peripheral surface. Examples usable as the lubricant feeder include a member formed from nonwoven fabric or felt made of heat-resistant fiber impregnated with a lubricant and a roller member formed by winding a porous fluororesin film around the surface of a heat-resistant sponge roller holding a lubricant.

Instead of the pressing roller 59, a belt-shaped pressing device may be used as an example of the pressing unit.

An image forming apparatus including a fixing device according to an aspect of the present invention is not limited to the image forming apparatus that forms color images illustrated in, for example, the first exemplary embodiment.

The image forming apparatus may be, for example, an image forming apparatus that forms color images in another form or an image forming apparatus that forms single-color images (such as monochrome images).

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A fixing device, comprising:

a rotatable fixing belt;

a contact portion that comes into contact with an inner peripheral surface of the fixing belt in a width direction;

a holding portion disposed opposite the inner peripheral surface of the fixing belt to guide and hold the fixing belt;

a pressing unit that presses the fixing belt against the contact portion;

a first protrusion and a second protrusion respectively disposed at portions of the holding portion upstream and downstream of the contact portion in a rotation direction of the fixing belt to come into contact with the inner peripheral surface of the fixing belt in the width direction; and a lubricant applied to the inner peripheral surface of the fixing belt, wherein at least one of the first protrusion and the second protrusion has a recess at at least a center portion of the protrusion in a longitudinal direction of the protrusion, corresponding to the width direction of the fixing belt, the recess being recessed in a direction away from the inner peripheral surface of the fixing belt and having a width decreasing downstream in the rotation direction of the fixing belt.

2. The fixing device according to claim 1, wherein the recess has a depth decreasing downstream in the rotation direction of the fixing belt.

3. The fixing device according to claim 2, wherein the recess is not recessed at a downstream end portion in the rotation direction of the fixing belt.

4. The fixing device according to claim 3, wherein, when the first protrusion has the recess, no protrusion that comes into contact with the inner peripheral surface of the fixing belt is disposed between the first protrusion and the contact portion.

5. The fixing device according to claim 3, further comprising:

a gap forming portion that forms a gap between the contact portion and the first protrusion of the holding portion, the gap extending in the width direction of the fixing belt and with which the fixing belt does not come in contact.

6. The fixing device according to claim 4, further comprising:

a gap forming portion that forms a gap between the contact portion and the first protrusion of the holding portion, the gap extending in the width direction of the fixing belt and with which the fixing belt does not come in contact.

7. The fixing device according to claim 2, wherein, when the first protrusion has the recess, no protrusion that comes into contact with the inner peripheral surface of the fixing belt is disposed between the first protrusion and the contact portion.

8. The fixing device according to claim 7, further comprising:

a gap forming portion that forms a gap between the contact portion and the first protrusion of the holding portion, the gap extending in the width direction of the fixing belt and with which the fixing belt does not come in contact.

9. The fixing device according to claim 2, further comprising:

a gap forming portion that forms a gap between the contact portion and the first protrusion of the holding portion, the gap extending in the width direction of the fixing belt and with which the fixing belt does not come in contact.

10. The fixing device according to claim 1, wherein, when the first protrusion has the recess, no protrusion that comes into contact with the inner peripheral surface of the fixing belt is disposed between the first protrusion and the contact portion.

11. The fixing device according to claim 10, further comprising:

a gap forming portion that forms a gap between the contact portion and the first protrusion of the holding portion, the gap extending in the width direction of the fixing belt and with which the fixing belt does not come in contact.

12. The fixing device according to claim 1, further comprising:

a gap forming portion that forms a gap between the contact portion and the first protrusion of the holding portion, the gap extending in the width direction of the fixing belt and with which the fixing belt does not come in contact.

13. The fixing device according to claim 1, wherein the at least one of the first protrusion and the second protrusion having the recess does not come into contact with the pressing unit with the fixing belt interposed therebetween.

14. An image forming apparatus, comprising a fixing device that fixes an unfixed image to a recording medium, wherein the fixing device is the fixing device according to claim 1.

15. A fixing device, comprising:

a rotatable fixing belt;

contact means for coming into contact with an inner peripheral surface of the fixing belt in a width direction;

holding means disposed opposite the inner peripheral surface of the fixing belt for guiding and holding the fixing belt;

pressing means for pressing the fixing belt against the contact means;

a first protrusion and a second protrusion respectively disposed at portions of the holding means upstream and downstream of the contact means in a rotation direction of the fixing belt to come into contact with the inner peripheral surface of the fixing belt in the width direction; and a lubricant applied to the inner peripheral surface of the fixing belt, wherein at least one of the first protrusion and the second protrusion has a recess at at least a center portion of the protrusion in a longitudinal direction of the protrusion, corresponding to the width direction of the fixing belt, the recess being recessed in a direction away from the inner peripheral surface of the fixing belt and having a width decreasing downstream in the rotation direction of the fixing belt.

* * * * *